US010071461B2

(12) United States Patent
Lehuu et al.

(10) Patent No.: US 10,071,461 B2
(45) Date of Patent: Sep. 11, 2018

(54) POLISHING PADS AND SYSTEMS AND METHODS OF MAKING AND USING THE SAME

(71) Applicant: 3M INNOVATIVE PROPERTIES COMPANY, St. Paul, MN (US)

(72) Inventors: Duy K. Lehuu, Lake Elmo, MN (US); Kenneth A. P. Meyer, White Bear Township, MN (US); Moses M. David, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 140 days.

(21) Appl. No.: 15/300,125

(22) PCT Filed: Mar. 31, 2015

(86) PCT No.: PCT/US2015/023572
§ 371 (c)(1),
(2) Date: Sep. 28, 2016

(87) PCT Pub. No.: WO2015/153597
PCT Pub. Date: Oct. 8, 2015

(65) Prior Publication Data

US 2017/0182629 A1 Jun. 29, 2017

Related U.S. Application Data

(60) Provisional application No. 61/974,848, filed on Apr. 3, 2014, provisional application No. 62/052,729, filed on Sep. 19, 2014.

(51) Int. Cl.
*B24B 37/22* (2012.01)
*B24B 37/26* (2012.01)
(Continued)

(52) U.S. Cl.
CPC ..... *B24B 37/26* (2013.01); *B24B 7/228* (2013.01); *B24B 37/22* (2013.01); *B24B 37/245* (2013.01)

(58) Field of Classification Search
CPC ..... B24B 37/26; B24B 7/228; B24B 37/22; B24B 37/245
(Continued)

(56) References Cited

U.S. PATENT DOCUMENTS 4,055,029 A * 10/1977 Kalbow ..... A47L 13/16 451/527
5,152,917 A 10/1992 Pieper
(Continued)

FOREIGN PATENT DOCUMENTS

CN 1905993 1/2007
JP H11-235656 8/1999
(Continued)

OTHER PUBLICATIONS

International Search Report for PCT International Application No. PCT/US2015/023572, dated Jul. 1, 2015, 4pgs.
(Continued)

*Primary Examiner* — George Nguyen
(74) *Attorney, Agent, or Firm* — Adam Bramwell; Jeffrey S. Kollodge

(57) ABSTRACT

The present disclosure relates to polishing pads which include a polishing layer, wherein the polishing layer includes a working surface and a second surface opposite the working surface. The working surface includes a plurality of precisely shaped pores, a plurality of precisely shaped asperities and a land region. The present disclosure further relates to a polishing system, the polishing system includes the preceding polishing pad and a polishing solution. The present disclosure relates to a method of polishing a sub-
(Continued)

strate, the method of polishing including: providing a polishing pad according to any one of the previous polishing pads; providing a substrate, contacting the working surface of the polishing pad with the substrate surface, moving the polishing pad and the substrate relative to one another while maintaining contact between the working surface of the polishing pad and the substrate surface, wherein polishing is conducted in the presence of a polishing solution.

43 Claims, 13 Drawing Sheets

(51) Int. Cl.
*B24B 37/24* (2012.01)
*B24B 7/22* (2006.01)

(58) Field of Classification Search
USPC ..... 451/41, 526–527
See application file for complete search history.

(56) References Cited

U.S. PATENT DOCUMENTS 5,212,910 A 5/1993 Breivogel
5,348,788 A * 9/1994 White ..... A61F 2/0077 428/131
5,435,816 A 7/1995 Spurgeon
5,441,598 A 8/1995 Yu
5,489,233 A 2/1996 Cook
5,778,481 A 7/1998 Amsden
5,882,251 A * 3/1999 Berman ..... B24B 37/26 451/285
5,944,589 A 8/1999 Nakajima
5,958,794 A 9/1999 Bruxvoort
6,155,910 A * 12/2000 Lamphere ..... B24B 7/24 451/41
6,234,875 B1 5/2001 Pendergrass, Jr.
6,285,001 B1 9/2001 Fleming
6,332,832 B1 * 12/2001 Suzuki ..... B24B 37/26 451/41
6,364,749 B1 4/2002 Walker
6,372,323 B1 4/2002 Kobe
6,390,891 B1 5/2002 Guha
6,419,556 B1 7/2002 Urbanavage
6,443,809 B1 9/2002 Leong
6,612,916 B2 9/2003 Kollodge
6,780,095 B1 * 8/2004 Moore ..... B24B 37/26 451/527
6,852,766 B1 2/2005 DeVoe
6,942,549 B2 9/2005 Khoury
7,029,747 B2 4/2006 Huh
7,091,255 B2 8/2006 DeVoe
7,098,255 B2 * 8/2006 Seyanagi ..... B24B 37/24 438/631
7,226,345 B1 6/2007 Dornfeld
8,137,166 B2 3/2012 Hsu
8,460,568 B2 6/2013 David
8,475,238 B2 7/2013 Choi
8,634,146 B2 1/2014 David
8,821,214 B2 9/2014 Joseph
2001/0019940 A1 9/2001 Agarwal
2002/0098789 A1 7/2002 Burke
2002/0127958 A1 9/2002 Blalock
2002/0173171 A1 11/2002 Moore
2003/0134581 A1 7/2003 Wang
2003/0217927 A1 11/2003 Basol
2004/0180611 A1 9/2004 Tajima
2004/0214510 A1 10/2004 So
2005/0064709 A1 3/2005 Shimomura
2005/0227489 A1 10/2005 Minamihara
2005/0277376 A1 12/2005 Pinder
2008/0003935 A1 1/2008 Feng
2008/0146129 A1 6/2008 Kouzuma
2008/0209816 A1 9/2008 Sung
2009/0093200 A1 4/2009 Iwase
2009/0215363 A1 8/2009 Sung
2010/0188751 A1 7/2010 Clarke
2012/0171935 A1 7/2012 Ruland
2012/0315830 A1 12/2012 Joseph
2013/0102231 A1 4/2013 Joseph
2013/0324020 A1 12/2013 Lefevre
2014/0273777 A1 9/2014 Lefevre
2014/0342646 A1 11/2014 Honda
2017/0182629 A1 * 6/2017 Lehuu ..... B24B 37/26

FOREIGN PATENT DOCUMENTS

JP H11-267961 10/1999
JP 2002-246343 8/2002
JP 2003-205451 7/2003
JP 2003-225855 8/2003
JP 2003-334753 11/2003
JP 2004-140178 5/2004
JP 5143528 5/2009
JP 2009-283538 12/2009
JP 2010-056184 3/2010
JP 2012-130992 7/2012
JP 2013-208696 10/2013
JP 2014-054719 3/2014
JP 2014-195839 10/2014
KR 2005-0012661 2/2005
WO WO 2004-058453 7/2004
WO WO 2005/077602 8/2005
WO WO 2006/089293 8/2006
WO WO 2010-032715 3/2010
WO WO 2013-081665 6/2013
WO WO 2015-013387 1/2015
WO WO 2015-153601 10/2015

OTHER PUBLICATIONS

"*Performance of Substrate Material for Superfire-Scale Integrated Circuit and Processing and Testing Technology Engineering*", Yuling Liu et. al., Metallurgical Industry Press, pp. 151-152.

* cited by examiner

POLISHING PADS AND SYSTEMS AND METHODS OF MAKING AND USING THE SAME

CROSS REFERENCE TO RELATED APPLICATIONS

This application is a national stage filing under 35 U.S.C. 371 of PCT/US2015/023572, filed Mar. 31, 2015, which claims the benefit of U.S. Provisional Application No. 61/974,848, filed Apr. 3, 2014, and U.S. Provisional Application No. 62/052,729, filed Sep. 19, 2014, the disclosure of which is incorporated by reference in its/their entirety herein.

FIELD

The present disclosure relates to polishing pads and systems useful for the polishing of substrates, and methods of making and using such polishing pads.

SUMMARY

In one embodiment, the present disclosure provides a polishing pad comprising a polishing layer having a working surface and a second surface opposite the working surface;

wherein the working surface includes a plurality of precisely shaped pores, a plurality of precisely shaped asperities and a land region;

wherein each pore has a pore opening, each asperity has an asperity base, and a plurality of the asperity bases are substantially coplanar relative to at least one adjacent pore opening;

wherein the depth of the plurality of precisely shaped pores is less than the thickness of the land region adjacent to each precisely shaped pore and the thickness of the land region is less than about 5 mm; and wherein the polishing layer comprises a polymer.

In another embodiment, the present disclosure provides a polishing pad including the previous polishing layer, wherein the polishing layer includes a plurality of nanometer-size topographical features on at least one of the surface of the precisely shaped asperities, the surface of the precisely shaped pores and the surface of the land region.

In another embodiment, the present disclosure provides a polishing pad including any one of the previous polishing layers, wherein the height of at least about 10% of the plurality of precisely shaped asperities is between about 1 micron and about 200 microns.

In another embodiment, the present disclosure provides a polishing pad including any one of the previous polishing layers, wherein the depth of at least about 10% of the plurality of precisely shaped pores is between about 1 micron and about 200 microns.

In another embodiment, the present disclosure provides a polishing pad including any one of the previous polishing layers, wherein the polishing layer further includes at least one macro-channel.

In another embodiment, the present disclosure provides a polishing pad including any one of the previous polishing layers, wherein the polishing layer further includes a plurality of independent or inter-connected macro-channels.

In another embodiment, the present disclosure provides a polishing pad including any one of the previous polishing layers, wherein the polishing pad further includes a subpad, wherein the subpad is adjacent to the second surface of the polishing layer.

In yet another embodiment, the present disclosure relates to the previous polishing pad further including a foam layer, wherein a foam layer is interposed between the second surface of the polishing layer and the subpad.

In another embodiment, the present disclosure provides a polishing system, the polishing system includes any one of the previous polishing pads and a polishing solution.

In yet another embodiment the present disclosure relates to the previous polishing system, wherein the polishing solution is a slurry.

In another embodiment, the present disclosure provides a method of polishing a substrate, the method comprising:

providing a polishing pad according to claim 1;

providing a substrate;

contacting the working surface of the polishing pad with the substrate surface;

moving the polishing pad and the substrate relative to one another while maintaining contact between the working surface of the polishing pad and the substrate surface, wherein polishing is conducted in the presence of a polishing solution.

In yet another embodiment the present disclosure relates to the previous method of polishing a substrate, wherein the polishing solution is a slurry.

The above summary of the present disclosure is not intended to describe each embodiment of the present disclosure. The details of one or more embodiments of the disclosure are also set forth in the description below. Other features, objects, and advantages of the disclosure will be apparent from the description and from the claims.

BRIEF DESCRIPTION OF THE DRAWINGS

The disclosure may be more completely understood in consideration of the following detailed description of various embodiments of the disclosure in connection with the accompanying figures, in which.

DETAILED DESCRIPTION

Figure 1A:
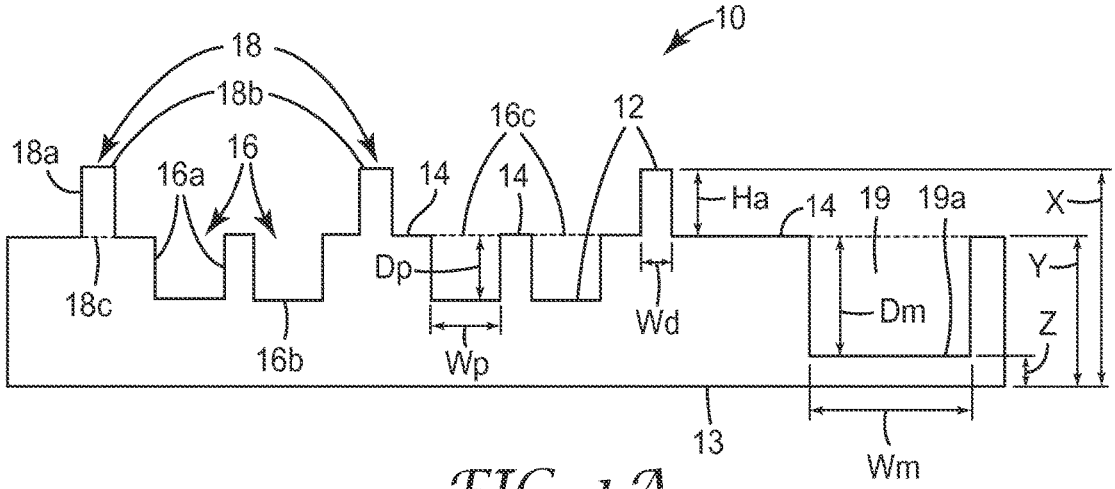
FIG. 1A is a schematic cross-sectional diagram of a portion of a polishing layer in accordance with some embodiments of the present disclosure.

Various articles, systems and methods have been employed for the polishing of substrates. The polishing articles, systems and methods are selected based on the desired end use characteristics of the substrates, including but not limited to, surface finish, e.g. surface roughness and defects (scratches, pitting and the like), and planarity, including both local planarity, i.e. planarity in a specific region of the substrate, and global planarity, i.e. planarity across the entire substrate surface. The polishing of substrates such as semiconductor wafers presents particularly difficult challenges, as end-use requirements may be extremely stringent due to the micron-scale and even nanometer-scale features that need to be polished to a required specification, e.g. surface finish. Often, along with improving or maintaining a desired surface finish, the polishing process also requires material removal, which may include material removal within a single substrate material or simultaneous material removal of a combination of two or more different materials, within the same plane or layer of the substrate. Materials that may be polished alone or simultaneously include both electrically insulating materials, i.e. dielectrics, and electrically conductive materials, e.g. metals. For example, during a single polishing step involving barrier layer chemical mechanical planarization (CMP), the polishing pad may be required to remove metal, e.g. copper, and/or adhesion/barrier layers and/or cap layers, e.g. tantalum and tantalum nitride, and/or dielectric material, e.g. an inorganic material, such as, silicone oxide or other glasses. Due to the differences in the material properties and polishing characteristics between the dielectric layers, metal layers, adhesion/barrier and/or cap layers, combined with the wafer feature sizes to be polished, the demands on the polishing pad can be extreme. In order to meet the rigorous requirements, the polishing pad and its corresponding mechanical properties need to be extremely consistent from pad to pad, else the polishing characteristics will change from pad to pad, which can adversely affect corresponding wafer processing times and final wafer parameters.

Currently, many CMP processes employ polishing pads with included pad topography, pad surface topography being particularly important. One type of topography relates to pad porosity, e.g. pores within the pad. The porosity is desired, as the polishing pad is usually used in conjunction with a polishing solution, typically a slurry (a fluid containing abrasive particles), and the porosity enables a portion of the polishing solution deposited on the pad to be contained in the pores. Generally, this is thought to facilitate the CMP process. Typically, polishing pads are organic materials that are polymeric in nature. One current approach to include pores in a polishing pad is to produce a polymeric foam polishing pad, where the pores are introduced as a result of the pad fabrication (foaming) process. Another approach is to prepare a pad composed of two or more different polymers, a polymer blend, that phase separates, forming a two phase structure. At least one of the polymers of the blend is water or solvent soluble and is extracted either prior to polishing or during the polishing process to create pores at least at or near the pad working surface. The working surface of the pad is the pad surface adjacent to and in at least partial contact with the substrate to be polished, e.g. a wafer surface. Introduction of pores in the polishing pad not only facilitates polishing solution usage, it also alters the mechanical properties of the pad, as porosity often leads to a softer or lower stiffness pad. The mechanical properties of the pad also play a key role in obtaining the desired polishing results. However, introduction of the pores via a foaming or polymer blend/extraction process, creates challenges in obtaining uniform pore size, uniform pore distribution and uniform total pore volumes within a single pad and from pad to pad. Additionally, as some of the process steps that are used to fabricate the pad are somewhat random in nature (foaming a polymer and mixing polymers to form a polymer blend), random variations in pore size, distribution and total pore volume can occur. This creates variation within a single pad and variations between different pads that may cause unacceptable variations in polishing performance.

A second type of pad topography critical to the polishing process relates to asperities on the pad surface. The current polymeric pads used in CMP, for example, often require a pad conditioning process to produce the desired pad surface topography. This surface topography includes asperities that will come into physical contact with the substrate surface being polished. The size and the distribution of the asperities are thought to be a key parameter with respect to the pad polishing performance. The pad conditioning process generally employs a pad conditioner, an abrasive article having abrasive particles, which is brought into contact with the pad surface at a designated pressure, while moving the pad surface and conditioner surface relative to each other. The abrasive particles of the pad conditioner abrade the surface of the polishing pad and create the desired surface texture, e.g. asperities. The use of a pad conditioner process brings additional variability into the polishing process, as obtaining the desired size, shape and areal density of asperities across the entire pad surface becomes dependent on both the process parameters of the conditioning process and how well they can be maintained, the uniformity of the abrasive surface of the pad conditioner and the uniformity of the pad mechanical properties across the pad surface and through the depth of the pad. This additional variability due to the pad conditioning process may also cause unacceptable variations in polishing performance.

Overall, there is a continuing need for improved polishing pads that can provide consistent, reproducible pad surface topography, e.g. asperities and/or porosity, both within a single pad and from pad to pad, to enable enhanced and/or more reproducible polishing performance.

Definitions

As used herein, the singular forms "a", "an", and "the" include plural referents unless the content clearly dictates otherwise. As used in this specification and the appended embodiments, the term "or" is generally employed in its sense including "and/or" unless the content clearly dictates otherwise.

As used herein, the recitation of numerical ranges by endpoints includes all numbers subsumed within that range (e.g. 1 to 5 includes 1, 1.5, 2, 2.75, 3, 3.8, 4, and 5).

Unless otherwise indicated, all numbers expressing quantities or ingredients, measurement of properties and so forth used in the specification and embodiments are to be understood as being modified in all instances by the term "about." Accordingly, unless indicated to the contrary, the numerical parameters set forth in the foregoing specification and attached listing of embodiments can vary depending upon the desired properties sought to be obtained by those skilled in the art utilizing the teachings of the present disclosure. At the very least, and not as an attempt to limit the application of the doctrine of equivalents to the scope of the claimed embodiments, each numerical parameter should at least be construed in light of the number of reported significant digits and by applying ordinary rounding techniques.

"Working surface" refers to the surface of a polishing pad that will be adjacent to and in at least partial contact with the surface of the substrate being polished.

"Pore" refers to a cavity in the working surface of a pad that allows a fluid, e.g. a liquid, to be contained therein. The pore enables at least some fluid to be contained within the pore and not flow out of the pore.

"Precisely shaped" refers to a topographical feature, e.g. an asperity or pore, having a molded shape that is the inverse shape of a corresponding mold cavity or mold protrusion, said shape being retained after the topographical feature is removed from the mold. A pore formed through a foaming process or removal of a soluble material (e.g. a water soluble particle) from a polymer matrix, is not a precisely shaped pore.

"Micro-replication" refers to a fabrication technique wherein precisely shaped topographical features are prepared by casting or molding a polymer (or polymer precursor that is later cured to form a polymer) in a production tool, e.g. a mold or embossing tool, wherein the production tool has a plurality of micron sized to millimeter sized topographical features. Upon removing the polymer from the production tool, a series of topographical features are present in the surface of the polymer. The topographical features of the polymer surface have the inverse shape as the features of the original production tool. The micro-replication fabrication techniques disclosed herein inherently result in the formation of a micro-replicated layer, i.e. a polishing layer, which includes micro-replicated asperities, i.e. precisely shaped asperities, when the production tool has cavities, and micro-replicated pores, i.e. precisely shaped pores, when the production tool has protrusions. If the production tool includes cavities and protrusions, the micro-replicated layer (polishing layer) will have both micro-replicated asperities, i.e. precisely shaped asperities, and micro-replicated pores, i.e. precisely shaped pores.

The present disclosure is directed to articles, systems, and methods useful for polishing substrates, including but not limited to, semiconductor wafers. The demanding tolerances associated with semiconductor wafer polishing require the use of consistent polishing pad materials and consistent polishing processes, including pad conditioning, to form the desired topography, e.g. asperities, in the pad surface. Current polishing pads, due to their fabrication processes, have inherent variability in key parameters, such as pore size, distribution and total volume across the pad surface and through the pad thickness. Additionally, there is variability in the asperity size and distribution across the pad surface, due to variability in the conditioning process and variability in the material properties of the pad. The polishing pads of the present disclosure overcome many of these issues by providing a working surface of the polishing pad that is precisely designed and engineered to have a plurality of reproducible topographical features, including asperities and pores. The asperities and pores are designed to have dimensions ranging from millimeters down to microns, with tolerances being as low as 1 micron or less. Due to the precisely engineered asperity topography, the polishing pads of the present disclosure may be used without conditioning process, eliminating the need for an abrasive pad conditioner and the corresponding conditioning process, resulting in considerable cost savings. Additionally, the precisely engineered pore topography insures uniform pores size and distribution across the polishing pad working surface, which leads to improved polishing performance and lower polishing solution usage.

A schematic cross-sectional diagram of a portion of a polishing layer 10 according to some embodiments of the present disclosure is shown in FIG. 1A. Polishing layer 10, having thickness X, includes working surface 12 and second surface 13 opposite working surface 12. Working surface 12 is a precisely engineered surface having precisely engineered topography. Working surface 12 includes a plurality of precisely shaped pores 16 having a depth Dp, sidewalls 16*a* and bases 16*b* and a plurality of precisely shaped asperities 18 having a height Ha, sidewalls 18*a* and distal ends 18*b*, the distal ends having width Wd. The width of the precisely shaped asperities and asperity bases may be the same as the width of their distal ends, Wd. Land region 14 is located in areas between precisely shaped pores 16 and precisely shaped asperities 18 and may be considered part of the working surface. The intersection of a precisely shaped asperity sidewall 18*a* with the surface of land region 14 adjacent thereto defines the location of the bottom of the asperity and defines a set of precisely shaped asperity bases 18*c*. The intersection of a precisely shaped pore sidewall 16*a* with the surface of land region 14 adjacent thereto is considered to be the top of the pore and defines a set of precisely shaped pore openings 16*c*, having a width Wp. As the bases of the precisely shaped asperities and the openings of adjacent precisely shaped pores are determined by the adjacent land region, the asperity bases are substantially coplanar relative to at least one adjacent pore opening. In some embodiment, a plurality of the asperity bases are substantially coplanar relative to at least one adjacent pore opening. A plurality of asperity bases may include at least about 10%, at least about 30%, at least about 50%, at least about 70%, at least about 80%, at least about 90%, at least about 95%, at least about 97%, at least about 99% or even at least about 100% of the total asperity bases of the polishing layer. The land region provides a distinct area of separation between the precisely shaped features, including separation between adjacent precisely shaped asperities and precisely shaped pores, separation between adjacent precisely shaped pores, and/or separation between adjacent precisely shaped asperities.

Land region 14 may be substantially planar and have a substantially uniform thickness, Y, although minor curvature and/or thickness variations consistent with the manufacturing process may be present. As the thickness of the land region, Y, must be greater than the depth of the plurality of precisely shaped pores, the land region may be of greater thickness than other abrasive articles known in the art that may have only asperities. In the embodiments of the present disclosure, the inclusion of a land region allows one to design the areal density of the plurality of precisely shaped asperities independent of the areal density of the plurality precisely shaped pores, providing greater design flexibility. This is in contrast to conventional pads which may include forming a series of intersecting grooves in a, generally, planar pad surface. The intersecting grooves lead to the formation of a textured working surface, with the grooves (regions where material was removed from the surface) defining the upper regions of the working surface (regions where material was not removed from the surface), i.e. regions that would contact the substrate being abraded or polished. In this known approach, the size, placement and number of grooves define the size, placement and number of upper regions of the working surface, i.e. the areal density of the upper regions of working surface are dependent on the areal density of the grooves. The grooves also may run the length of the pad allowing the polishing solution to flow out of the groove, in contrast to a pore that can contain the polishing solution. Particularly, the inclusion of precisely shaped pores, which can hold and retain the polishing solution proximate to the working surface, may provide enhanced polishing solution delivery for demanding applications, e.g. CMP.

Polishing layer 10 may include at least one macro-channel. FIG. 1A shows macro-channel 19 having width Wm, a depth Dm and base 19*a*. A secondary land region having a thickness, Z, is defined by macro-channel base 19*a*. The secondary land region defined by the base of the macro-channel would not be considered part of land region 14, previously described. In some embodiments, one or more secondary pores (not shown) may be included in at least a portion of the base of the at least one macro-channel. The one or more secondary pores have secondary pore openings (not shown), the secondary pore openings being substantially coplanar with base 19*a* of the macro-channel 19. In some embodiments, the base of the at least one macro-channel is substantially free of secondary pores.

The shape of precisely shaped pores 16 is not particularly limited and includes, but is not limited to, cylinders, half spheres, cubes, rectangular prism, triangular prism, hexagonal prism, triangular pyramid, 4, 5 and 6-sided pyramids, truncated pyramids, cones, truncated cones and the like. The lowest point of a precisely shaped pore 16, relative to the pore opening, is considered to be the bottom of the pore. The shape of all the precisely shaped pores 16 may all be the same or combinations may be used. In some embodiments, at least about 10%, at least about 30%, at least about 50%, at least about 70%, at least about 90%, at least about 95%, at least about 97%, at least about 99% or even at least about 100% of the precisely shaped pores are designed to have the same shape and dimensions. Due to the precision fabrication processes used to fabricate the precisely shaped pores, the tolerances are, generally, small. For a plurality of precisely shaped pores designed to have the same pore dimensions, the pore dimensions are uniform. In some embodiments, the percent non-uniformity of at least one distance dimension corresponding to the size of the plurality of precisely shaped pores; e.g. height, width of a pore opening, length, and diameter; is less than about 20%, less than about 15%, less than about 10%, less than about 8%, less than about 6% less than about 4%, less than about 3%, less than about 2%, less than about 1.5%, or even less than about 1%. The percent non-uniformity is the standard deviation of a set of values divided by the average of the set of values multiplied by 100. The standard deviation and average can be measured by known statistical techniques. The standard deviation may be calculated from a sample size of at least 10 pores, at least 15 pores or even at least 20 pores. The sample size may be no greater than 200 pores, no greater than 100 pores or even no greater than 50 pores. The sample may be selected randomly from a single region on the polishing layer or from multiple regions of the polishing layer.

The longest dimension of the precisely shaped pore openings 16*c*, e.g. the diameter when the precisely shaped pores 16 are cylindrical in shape, may be less than about 10 mm, less than about 5 mm, less than about 1 mm, less than about 500 microns, less than about 200 microns, less than about 100 microns, less than about 90 microns, less than about 80 microns, less than about 70 microns or even less than about 60 microns. The longest dimension of the precisely shaped pore openings 16*c* may be greater than about 1 micron, greater than about 5 microns, greater than about 10 microns, greater than about 15 microns or even greater than about 20 microns. The cross-sectional area of the precisely shaped pores 16, e.g. a circle when the precisely shaped pores 16 are cylindrical in shape, may be uniform throughout the depth of the pore, or may decrease, if the precisely shaped pore sidewalls 16*a* taper inward from opening to base, or may increase, if the precisely shaped pore sidewalls 16*a* taper outward. The precisely shaped pore openings 16*c* may all have about the same longest dimensions or the longest dimension may vary between precisely shaped pore openings 16*c* or between sets of different precisely shaped pore openings 16*c*, per design. The width, Wp, of the precisely shaped pore openings may be equal to the values give for the longest dimension, described above.

The depth of the plurality of precisely shaped pores, Dp, is only limited by the thickness Y of land region 14 of polishing layer 10. In some embodiments, the depth of the plurality of precisely shaped pores is less than the thickness of the land region adjacent to each precisely shaped pore, i.e. the precisely shaped pores are not through-holes that go through the entire thickness of land region 14. This enables the pores to trap and retain fluid proximate the working surface. Although the depth of the plurality of precisely shaped pores is limited as indicated above, this does not prevent the inclusion of one or more other through-holes in the pad, e.g. through-holes to provide polishing solution up through the polishing layer to the working surface or a path for airflow through the pad. A through-hole is defined as a hole going through the entire thickness, Y, of the land region 14.

In some embodiments, the polishing layer is free of through-holes. As the pad is often mounted to another substrate, e.g. a sub-pad or platen, via an adhesive, e.g. a pressure sensitive adhesive, through-holes may allow the polishing solution to seep through the pad to the pad-adhesive interface. The polishing solution may be corrosive to the adhesive and cause a detrimental loss in the integrity of the bond between the pad and the substrate to which it is attached.

Besides the limitation with respect to the thickness of the land region described above, the depth of the precisely shaped pores is not particularly limited. The depth, Dp, of the plurality of precisely shaped pores 16 may be less than about 5 mm, less than about 1 mm, less than about 500 microns, less than about 200 microns, less than about 100 microns, less than about 90 microns, less than about 80 microns, less than about 70 microns or even less than about 60 microns. The depth of the precisely shaped pores 16 may be greater than about 1 micron, greater than about 5 microns, greater than about 10 microns, greater than about 15 microns or even greater than about 20 microns. The depth of the plurality precisely shaped pores may be between about 1 micron and about 5 mm, between about 1 micron and about 1 mm, between about 1 micron and about 500 microns, between about 1 microns and about 200 microns, between about 1 microns and about 100 microns, 5 micron and about 5 mm, between about 5 micron and about 1 mm, between about 5 micron and about 500 microns, between about 5 microns and about 200 microns or even between about 5 microns and about 100 microns The precisely shaped pores 16 may all have the same depth or the depth may vary between precisely shaped pores 16 or between sets of different precisely shaped pores 16.

In some embodiment, the depth of at least about 10%, at least about 30% at least about 50%, at least 70%, at least about 80%, at least about 90%, at least about 95% or even at least about 100% of the plurality precisely shaped pores is between about 1 micron and about 500 microns, between about 1 micron and about 200 microns, between about 1 micron and about 150 microns, between about 1 micron and about 100 micron, between about 1 micron and about 80 microns, between about 1 micron and about 60 microns, between about 5 microns and about 500 microns, between about 5 micron and about 200 microns, between about 5 microns and 150 microns, between about 5 micron and about 100 micron, between about 5 micron and about 80 microns, between about 5 micron and about 60 microns, between about 10 microns and about 200 microns, between about 10 microns and about 150 microns or even between about 10 microns and about 100 microns.

In some embodiments, the depth of at least a portion of, up to and including all, the plurality of precisely shaped pores is less than the depth of at least a portion of the at least one macro-channel. In some embodiments, the depth of at least about 50%, at least about 60%, at least about 70%, at least about 80%, at least about 90%, at least about 95%, at least about 99% and even at least about 100% of the plurality of precisely pores is less than the depth of at least a portion of a macro-channel.

The precisely shaped pores 16 may be uniformly distributed, i.e. have a single areal density, across the surface of polishing layer 10 or may have different areal density across the surface of polishing layer 10. The areal density of the precisely shaped pores 16 may be less than about 1,000,000/mm$^2$, less than about 500,000/mm$^2$, less than about 100,000/mm$^2$, less than about 50,000/mm$^2$, less than about 10,000/mm$^2$, less than about 5,000/mm$^2$, less than about 1,000/mm$^2$, less than about 500/mm$^2$, less than about 100/mm$^2$, less than about 50/mm$^2$, less than about 10/mm$^2$, or even less than about 5/mm$^2$. The areal density of the precisely shaped pores 16 may be greater than about 1/dm$^2$, may be greater than about 10/dm$^2$, greater than about 100/dm$^2$, greater than about 5/cm$^2$, greater than about 10/cm$^2$, greater than about 100/cm$^2$, or even greater than about 500/cm$^2$.

The ratio of the total cross-sectional area of the precisely shaped pore openings 16*c*, to the projected polishing pad surface area may be greater than about 0.5%, greater than about 1%, greater than about 3% greater than about 5%, greater than about 10%, greater than about 20%, greater than about 30%, greater than about 40% or even greater than about 50%. The ratio of the total cross-sectional area of the precisely shaped pore openings 16*c*, with respect to the projected polishing pad surface area may be less than about 90%, less than about 80%, less than about 70%, less than about 60%, less than about 50% less than about 40%, less than about 30%, less than about 25% or even less than about 20%. The projected polishing pad surface area is the area resulting from projecting the shape of the polishing pad onto a plane. For example, a circular shaped polishing pad having a radius, r, would have a projected surface area of pi times the radius squared, i.e. the area of the projected circle on a plane.

The precisely shaped pores 16 may be arranged randomly across the surface of polishing layer 10 or may be arranged in a pattern, e.g. a repeating pattern, across polishing layer 10. Patterns include, but are not limited to, square arrays, hexagonal arrays and the like. Combination of patterns may be used.

The shape of precisely shaped asperities 18 is not particularly limited and includes, but is not limited to, cylinders, half spheres, cubes, rectangular prism, triangular prism, hexagonal prism, triangular pyramid, 4, 5 and 6-sided pyramids, truncated pyramids, cones, truncated cones and the like. The intersection of a precisely shaped asperity sidewall 18*a* with the land region 14 is considered to be the base of the asperity. The highest point of a precisely shaped asperity 18, as measured from the asperity base 18*c* to a distal end 18*b*, is considered to be the top of the asperity and the distance between the distal end 18*b* and asperity base 18*c* is the height of the asperity. The shape of all the precisely shaped asperities 18 may all be the same or combinations may be used. In some embodiments, at least about 10%, at least about 30%, at least about 50%, at least about 70%, at least about 90%, at least about 95%, at least about 97%, at least about 99% or even at least about 100% of the precisely shaped asperities are designed to have the same shape and dimensions. Due to the precision fabrication processes used to fabricate the precisely shaped asperities, the tolerances are, generally, small. For a plurality of precisely shaped asperities designed to have the same asperity dimensions, the asperity dimensions are uniform. In some embodiments, the percent non-uniformity of at least one distance dimension corresponding to the size of a plurality of precisely shaped asperities, e.g. height, width of a distal end, width at the base, length, and diameter, is less than about 20%, less than about 15%, less than about 10%, less than about 8%, less than about 6% less than about 4%, less than about 3%, less than about 2%, less than about 1.5% or even less than about 1%. The percent non-uniformity is the standard deviation of a set of values divided by the average of the set of values mulitplied by 100. The standard deviation and average can be measured by known statistical techniques. The standard deviation may be calculated from a sample size of at least 10 asperities at least 15 asperities or even at least 20 asperities or even more. The sample size may be no greater than 200 asperities, no greater than 100 asperities or even no greater than 50 asperities. The sample may be selected randomly from a single region on the polishing layer or from multiple regions of the polishing layer.

In some embodiments, at least about 50%, at least about 70%, at least about 90%, at least about 95%, at least about 97%, at least about 99% and even at least about 100% of the precisely shaped asperities are solid structures. A solid structure is defined as a structure that contains less than about 10%, less than about 5%, less than about 3%, less than about 2%, less than about 1%, less than about 0.5% or even 0% porosity by volume. Porosity may include open cell or closed cell structures, as would be found for example in a foam, or machined holes purposely fabricated in the asperities by known techniques, such as, punching, drilling, die cutting, laser cutting, water jet cutting and the like. In some embodiments, the precisely shaped asperities are free of machined holes. As a result of the machining process, machined holes may have unwanted material deformation or build-up near the edge of the hole that can cause defects in the surface of the substrates being polished, e.g. semiconductor wafers.

The longest dimension, with respect to the cross-sectional area of the precisely shaped asperities 18, e.g. the diameter when the precisely shaped asperities 18 are cylindrical in shape, may be less than about 10 mm, less than about 5 mm, less than about 1 mm, less than about 500 microns, less than about 200 microns, less than about 100 microns, less than about 90 microns, less than about 80 microns, less than about 70 microns or even less than about 60 microns. The longest dimension of the of the precisely shaped asperities 18 may be greater than about 1 micron, greater than about 5 microns, greater than about 10 microns, greater than about 15 microns or even greater than about 20 microns. The cross-sectional area of the precisely shaped asperities 18, e.g. a circle when the precisely shaped asperities 18 are cylindrical in shape, may be uniform throughout the height of the asperities, or may decrease, if the precisely shaped asperities' sidewalls 18*a* taper inward from the top of the asperity to the base, or may increase, if the precisely shaped asperities' sidewalls 18*a* taper outward from the top of the asperity to the bases. The precisely shaped asperities 18 may all have the same longest dimensions or the longest dimension may vary between precisely shaped asperities 18 or between sets of different precisely shaped asperities 18, per design. The width, Wd, of the distal ends of the precisely shaped asperity bases may be equal to the values give for the longest dimension, described above. The width of the precisely shaped asperity bases may be equal to the values give for the longest dimension, described above.

The height of the precisely shaped asperities 18 may be may be less than about 5 mm, less than about 1 mm, less than about 500 microns, less than about 200 microns, less than about 100 microns, less than about 90 microns, less than about 80 microns, less than about 70 microns or even less than about 60 microns. The height of the precisely shaped asperities 18 may be greater than about 1 micron, greater than about 5 microns, greater than about 10 microns, greater than about 15 microns or even greater than about 20 microns. The precisely shaped asperities 18 may all have the same height or the height may vary between precisely shaped asperities 18 or between sets of different precisely shaped asperities 18. In some embodiments, the polishing layer's working surface includes a first set of precisely shaped asperities and at least one second set of precisely shaped asperities wherein the height of the first set of precisely shaped asperities is greater than the height of the seconds set of precisely shaped asperities. Having multiple sets of a plurality of precisely shaped asperities, each set having different heights, may provide different planes of polishing asperities. This may become particularly beneficial, if the asperity surfaces have been modified to be hydrophilic, and, after some degree of polishing the, first set of asperities are worn down (including removal of the hydrophilic surface), allowing the second set of asperities to make contact with the substrate being polished and provide fresh asperities for polishing. The second set of asperities may also have a hydrophilic surface and enhance polishing performance over the worn first set of asperities. The first set of the plurality of precisely shaped asperities may have a height between 3 microns and 50 microns, between 3 microns and 30 microns, between 3 microns and 20 microns, between 5 microns and 50 microns, between 5 microns and 30 microns, between 5 microns and 20 microns, between 10 microns and 50 microns, between 10 microns and 30 microns, or even between 10 microns and 20 microns greater than the height of the at least one second set of the plurality of precisely shaped asperities.

In some embodiment, in order to facilitate the utility of the polishing solution at the polishing layer-polishing substrate interface, the height of at least about 10%, at least about 30% at least about 50%, at least 70%, at least about 80%, at least about 90%, at least about 95% or even at least about 100% of the plurality precisely shaped asperities is between about 1 micron and about 500 microns, between about 1 micron and about 200 microns, between about 1 micron and about 100 micron, between about 1 micron and about 80 microns, between about 1 micron and about 60 microns, between about 5 microns and about 500 microns, between about 5 micron and about 200 microns, between about 5 microns and about 150 microns, between about 5 micron and about 100 micron, between about 5 micron and about 80 microns, between about 5 micron and about 60 microns, between about 10 microns and about 200 microns, between about 10 microns and about 150 microns or even between about 10 microns and about 100 microns.

The precisely shaped asperities 18 may be uniformly distributed, i.e. have a single areal density, across the surface of the polishing layer 10 or may have different areal density across the surface of the polishing layer 10. The areal density of the precisely shaped asperities 18 may be less than about 1,000,000/mm$^2$, less than about 500,000/mm$^2$, less than about 100,000/mm$^2$, less than about 50,000/mm$^2$, less than about 10,000/mm$^2$, less than about 5,000/mm$^2$, less than about 1,000/mm$^2$, less than about 500/mm$^2$, less than about 100/mm$^2$, less than about 50/mm$^2$, less than about 10/mm$^2$, or even less than about 5/mm$^2$. The areal density of the precisely shaped asperities 18 may be greater than about 1/dm$^2$, may be greater than about 10/dm$^2$, greater than about 100/dm$^2$, greater than about 5/cm$^2$, greater than about 10/cm$^2$, greater than about 100/cm$^2$, or even greater than about 500/cm$^2$. In some embodiments, the areal density of the plurality of precisely shaped asperities is independent of the areal density of the plurality precisely shaped pores.

The precisely shaped asperities 18 may be arranged randomly across the surface of polishing layer 10 or may be arranged in a pattern, e.g. a repeating pattern, across polishing layer 10. Patterns include, but are not limited to, square arrays, hexagonal arrays and the like. Combination of patterns may be used.

The total cross-sectional area of distal ends 18*b* with respect to the total projected polishing pad surface area may be greater than about 0.01%, greater than about 0.05%, greater than about 0.1%, greater than about 0.5%, greater than about 1%, greater than about 3% greater than about 5%, greater than about 10%, greater than about 15%, greater than about 20% or even greater than about 30%. The total cross-sectional area of distal ends 18*b* of precisely shaped asperities 18 with respect to the total projected polishing pad surface area may be less than about 90%, less than about 80%, less than about 70%, less than about 60%, less than about 50% less than about 40%, less than about 30%, less than about 25% or even less than about 20%. The total cross-sectional area of the precisely shaped asperity bases with respect to the total projected polishing pad surface area may be the same as described for the distal ends.

Figure 2:
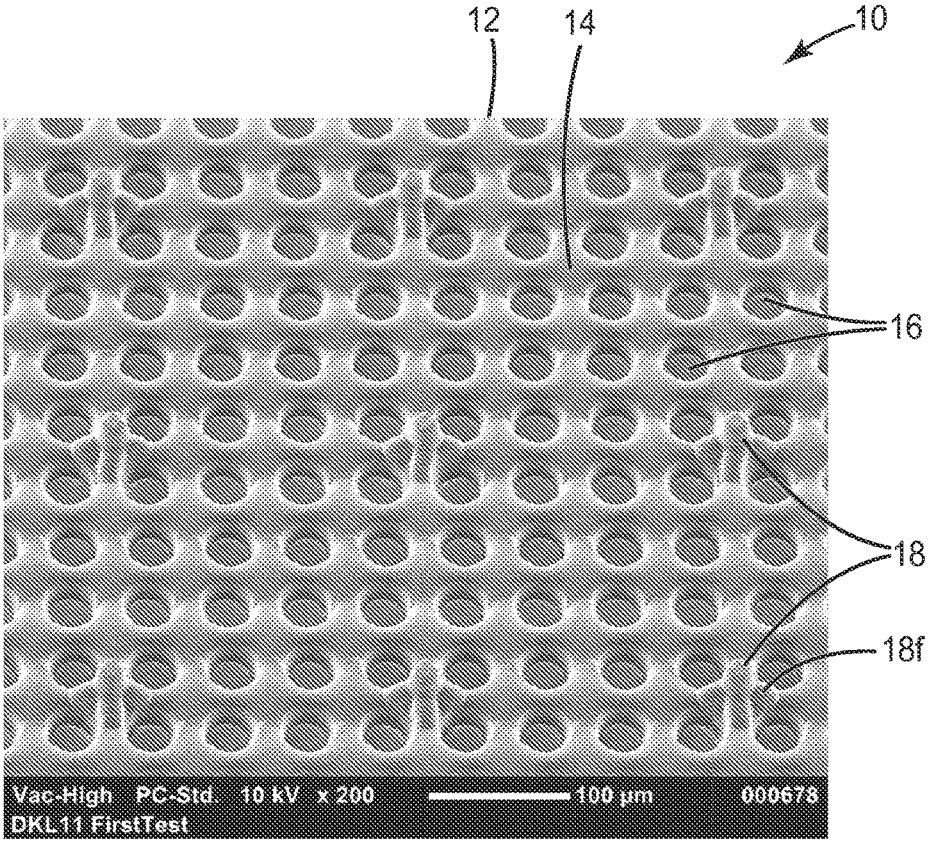
FIG. 2 is an SEM image of a portion of a polishing layer of a polishing pad in accordance with some embodiments of the present disclosure.

FIG. 2 is a SEM image of polishing layer 10 of a polishing pad in accordance with one embodiment of the present disclosure. The polishing layer 10 includes working surface 12, which is a precisely engineered surface having precisely engineered topography. The working surface 12 of FIG. 2 includes a plurality of precisely shaped pores 16 and a plurality of precisely shaped asperities 18. The precisely shaped pores 16 are cylindrical in shape having a diameter of about 42 microns at the pore opening and a depth of about 30 microns. The precisely shaped pores 16 are arranged in a square array having a center to center distance of about 60 microns. The total cross-sectional area of the precisely shaped pore openings, i.e. the sum of the cross-sectional areas of the plurality of pore openings, is about 45% relative to the total projected surface area of the polishing pad. The precisely shaped asperities 18 are cylindrical in shape having a diameter of about 20 microns at the distal ends and a height of about 30 microns. The precisely shaped asperities 18 are located on the land region 14 between the precisely shaped pores 16. The precisely shaped asperities 18 are arranged in square array with a center to center distance of about 230 microns. The precisely shaped asperities 18 each have four flanges 18*f* protruding radial at intervals of 90° around the asperity. The flanges 18*f* start at about 10 microns from the top of the precisely shaped asperity 18, taper and end at the land region 14 about 15 microns from the base of the asperity. The total cross-sectional area of the distal ends of the plurality of precisely shaped asperities 18, i.e. the sum of the cross-sectional areas of distal ends of the plurality of asperities, is about 0.6% relative to the total projected surface area of the polishing pad.

In general, the flanges provide support for the precisely shaped asperities, preventing them from bending excessively during the polishing process and enabling their distal ends to maintain contact with the surface of the substrate being polished. Although precisely shaped asperities in FIG. 2 each have four flanges, the number of flanges per asperity can vary according to the design of the precisely shaped asperity pattern and/or the design of the polishing layer. Zero, one, two, three, four, five, six or even more than six flanges per asperity may be used. The number of flanges per asperity may vary from asperity to asperity, depending on the final design parameters of the polishing layer and their relation to polishing performance. For example, some precisely shaped asperities may have no flanges while other precisely shaped asperities may have two flanges and other precisely shaped asperities may have four flanges. In some embodiments, at least a portion of the precisely shaped asperities include a flange. In some embodiments all of the precisely shaped asperities include a flange.

Figure 3:
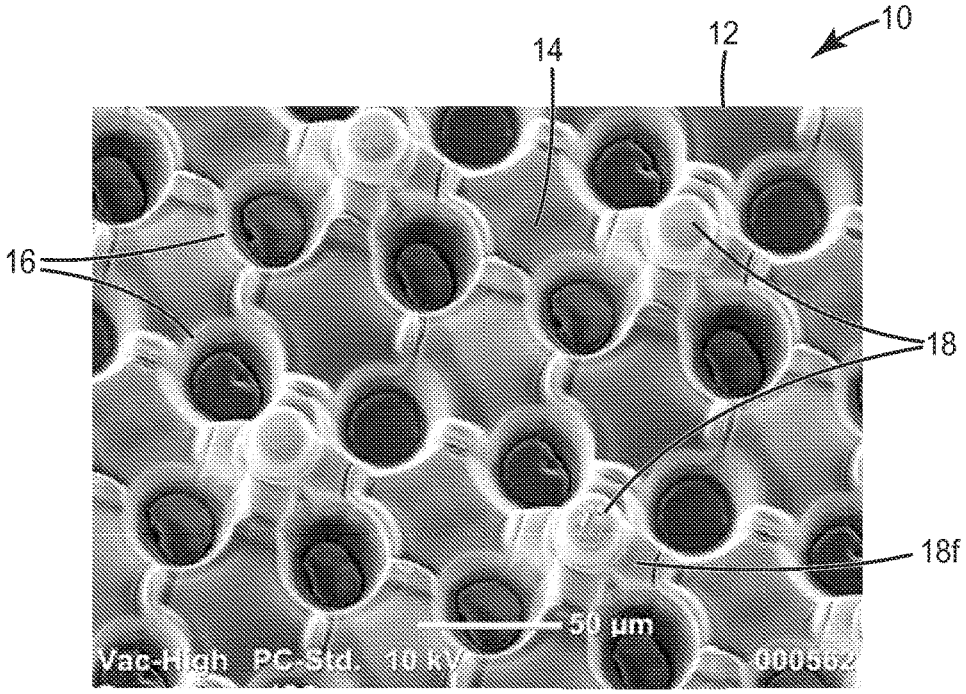
FIG. 3 is an SEM image of a portion of a polishing layer of a polishing pad in accordance with some embodiments of the present disclosure.

FIG. 3 is a SEM image of polishing layer 10 of a polishing pad in accordance with another embodiment of the present disclosure. The polishing layer 10 includes working surface 12, which is a precisely engineered surface having precisely engineered topography. The working surface of FIG. 3 includes a plurality of precisely shaped pores 16 and a plurality of precisely shaped asperities 18. The precisely shaped pores 16 are cylindrical in shape having a diameter of about 42 microns at the pore openings and a depth of about 30 microns. The precisely shaped pores 16 are arranged in a square array having a center to center distance of about 60 microns. The total cross-sectional area of the precisely shaped pore openings, i.e. the sum of the cross-sectional areas of the plurality of pore openings, is about 45% relative to the total projected surface area of the polishing pad. The precisely shaped asperities 18 are cylindrical in shape having a diameter of about 20 microns at the distal ends and a height of about 30 microns. The precisely shaped asperities are located on the land region 14 between the precisely shaped pores 16. The precisely shaped asperities 18 are arranged in square array with a center to center distance of about 120 microns. The precisely shaped asperities 18 each have four flanges 18*f* protruding radial at intervals of 90° around the asperity. The flanges 18*f* start at about 10 microns from the top of the precisely shaped asperity 18, taper and end at the land region 14 about 15 microns from the base of the asperity. The total cross-sectional area of the distal ends of the precisely shaped asperities 18, i.e. the sum of the cross-sectional areas of the distal ends of the plurality of asperities, is about 2.4% relative to the total projected surface area of the polishing pad.

Figure 4:
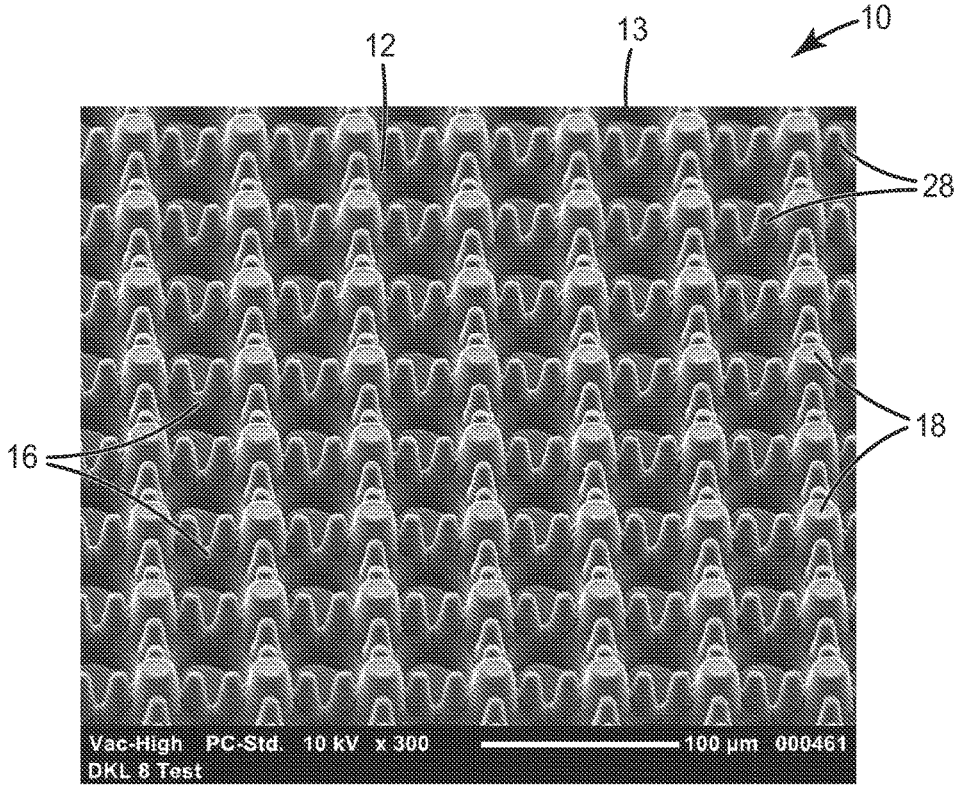
FIG. 4 is an SEM image of a portion of a polishing layer of a polishing pad in accordance with some embodiments of the present disclosure.

FIG. 4 is a SEM image of polishing layer 10 of a polishing pad in accordance with another embodiment of the present disclosure. The polishing layer 10 includes working surface 12, which is a precisely engineered surface having precisely engineered topography. The working surface of FIG. 4 includes a plurality of precisely shaped pores 16 and a plurality of precisely shaped asperities 18 and 28. In this embodiment, two different sized cylindrical shaped asperities are used. The cylinders are somewhat tapered, due to the fabrication process. The larger size precisely shaped asperities 18 have a maximum diameter of about 20 micron and a height of about 20 micron. The smaller size precisely shaped asperities 28, positioned between precisely shaped asperities 18, have a maximum diameter of about 9 microns and a height of about 15 microns. The total cross-sectional area of the precisely shaped asperities 18, i.e. the sum of the cross-sectional areas of the plurality of larger asperities at the maximum diameter, is about 7% relative to the total projected surface area of the polishing pad and the sum of the cross-sectional areas at the maximum diameter of the plurality of smaller asperities is about 5% relative to the total projected surface area of the polishing pad. The precisely shaped pores 16 are cylindrical in shape having a diameter of about 42 microns at the pore openings and a depth, of about 30 microns. The precisely shaped pores 16 are arranged in a square array having a center to center distance of about 60 microns. The total cross-sectional area of the precisely shaped pore openings, i.e. the sum of the cross-sectional areas of the plurality of pore openings, is about 45% relative to the total projected surface area of the polishing pad.

Figure 5:
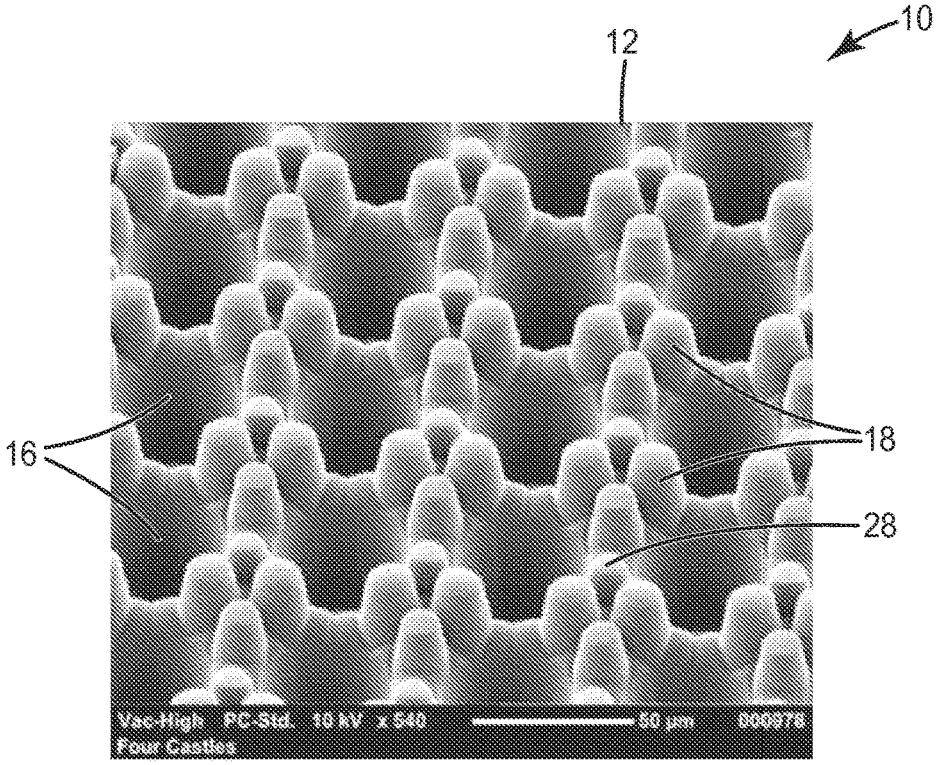
FIG. 5 is an SEM image of a polishing layer of a portion of a polishing pad in accordance with some embodiments of the present disclosure.

FIG. 5 is a SEM image of polishing layer 10 of a polishing pad in accordance with another embodiment of the present disclosure. The polishing layer 10 includes working surface 12, which is a precisely engineered surface having precisely engineered topography. The working surface shown in FIG. 5 includes a plurality of precisely shaped pores 16 and a plurality of precisely shaped asperities 18 and 28. In this embodiment, two different sized cylindrical shaped asperities are used. The cylinders are somewhat tapered, due to the fabrication process. The larger size precisely shaped asperities 18 have a maximum diameter of about 15 microns and a height of about 20 microns. The smaller size precisely shaped asperities 28 have a maximum diameter of about 13 microns and a height of about 15 microns. The total cross-sectional area of the precisely shaped asperities 18, i.e. the sum of the cross-sectional areas of the plurality of larger asperities at the maximum diameter, is about 7% relative to the total projected surface area of the polishing pad and the sum of the cross-sectional areas of the plurality of smaller asperities at the maximum diameter is about 5% relative to the total projected surface area of the polishing pad. The precisely shaped pores 16 are cylindrical in shape having a diameter of about 42 microns at the pore openings and a depth of about 30 microns. The precisely shaped pores 16 are arranged in a square array having a center to center distance of about 60 microns. The total cross-sectional area of the precisely shaped pore openings, i.e. the sum of the cross-sectional areas of the plurality of pore openings, is about 45% relative to the total projected surface area of the polishing pad.

The precisely shaped pores and precisely shaped asperities of the polishing layer may be fabricated by an embossing process. A master tool is prepared with the negative of the desired surface topography. A polymer melt is applied to the surface of the master tool followed by pressure being applied to the polymer melt. Upon cooling the polymer melt to solidify the polymer into a film layer, the polymer film layer is removed from the master tool resulting in a polishing layer which includes precisely shaped pores and precisely shaped asperities.

Figure 6:
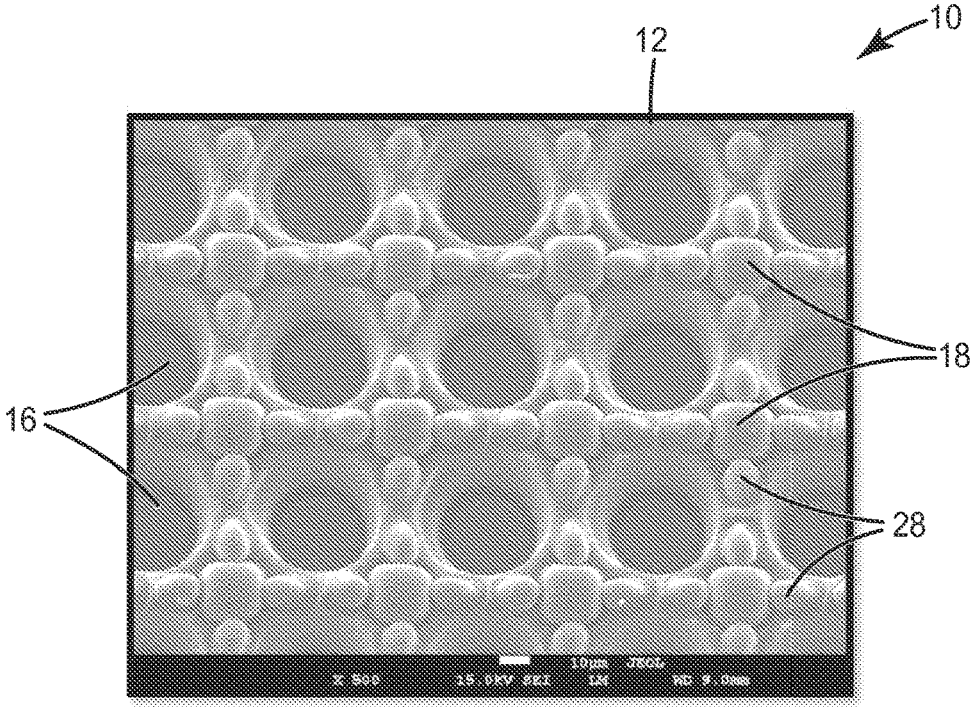
FIG. 6 is an SEM image of a polishing layer of a portion of a polishing pad in accordance with some embodiments of the present disclosure.

FIG. 6 is a SEM image of polishing layer 10 of a polishing pad in accordance with another embodiment of the present disclosure. The polishing layer 10 includes working surface 12, which is a precisely engineered surface having precisely engineered topography. The working surface of FIG. 6 includes a plurality of precisely shaped pores 16 and a plurality of precisely shaped asperities 18 and 28. In this embodiment, two different sized cylindrical shaped asperities are used. The polishing layer 10 of FIG. 6 was prepared from the same master tool as that of the polishing layer 10 of FIG. 4. However, the pressure applied during embossing was reduced, causing the polymer melt to not fully fill the pores of the master tool negative, which correspond to asperities in the polishing layer 10. Consequently, the larger sized precisely shaped asperities 18 still have a maximum diameter of about 20 micron but the height has been reduced to about 13 microns. Due to this fabrication process, the cylindrical shape also appears to be somewhat square. The smaller size precisely shaped asperities 28, positioned between precisely shaped asperities 18, have a maximum diameter of about 9 microns and a height of about 13 microns. The total cross-sectional area of the precisely shaped asperities 18 and 28, i.e. the sum of the cross-sectional areas of the plurality of asperities at their maximum cross-sectional dimension, is about 14% relative to the total projected pad surface area. The precisely shaped pores 16 are cylindrical in shape having a diameter of about 42 microns at the pore openings and a depth of about 30 microns. The precisely shaped pores 16 are arranged in a square array having a center to center distance of about 60 microns. The total cross-sectional area of the precisely shaped pore openings, i.e. the sum of the cross-sectional areas of the plurality of pore openings, is about 45% relative to the total projected surface area of the polishing pad.

Figure 7:
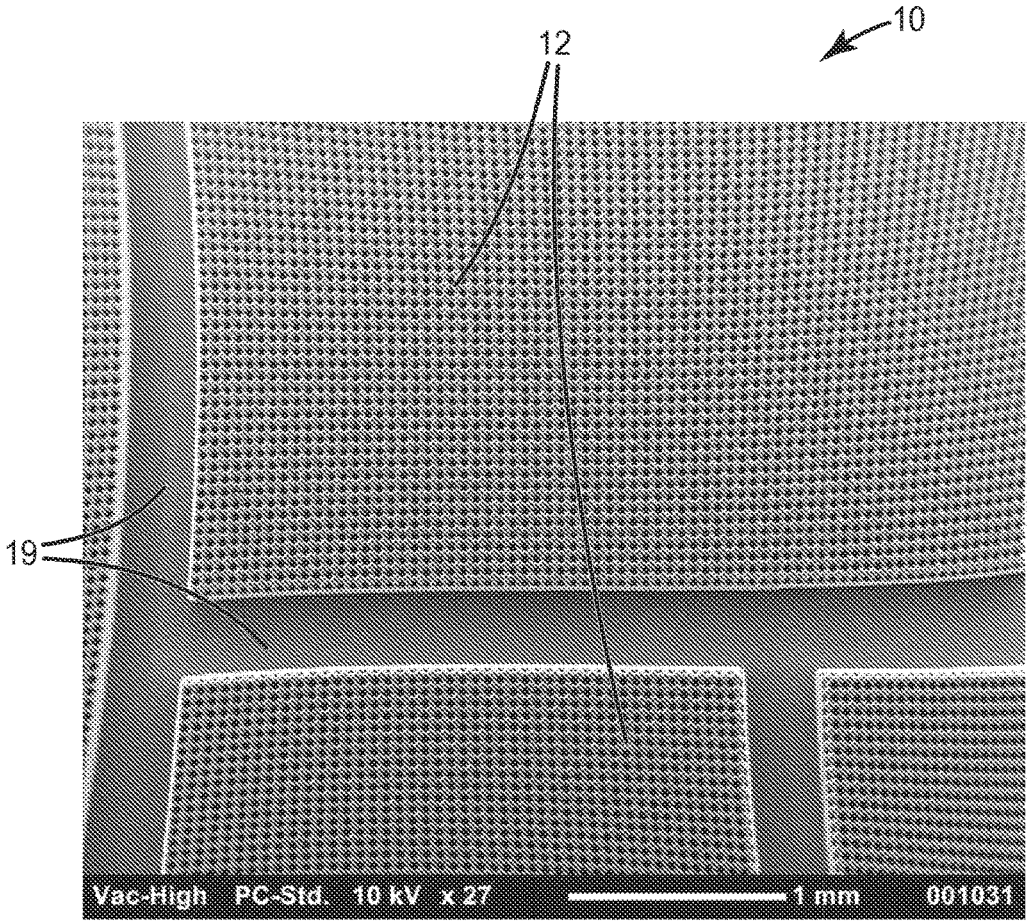
FIG. 7 is an SEM image of the polishing layer of the polishing pad shown in FIG. 6, at a lower magnification, showing macro-channels in the working surface.

FIG. 7 is a SEM image of polishing layer 10 of the polishing pad shown in FIG. 6, except the magnification has been lowered to show a larger area of the polishing layer 10. Polishing layer 10 includes regions of working surface 12, which include precisely shaped pores and precisely shaped asperities. Macro-channels 19 are also shown, macro-channels 19 being inter-connected. Macro-channels 19 are about 400 microns wide and have a depth of about 250 microns.

Figure 8A:
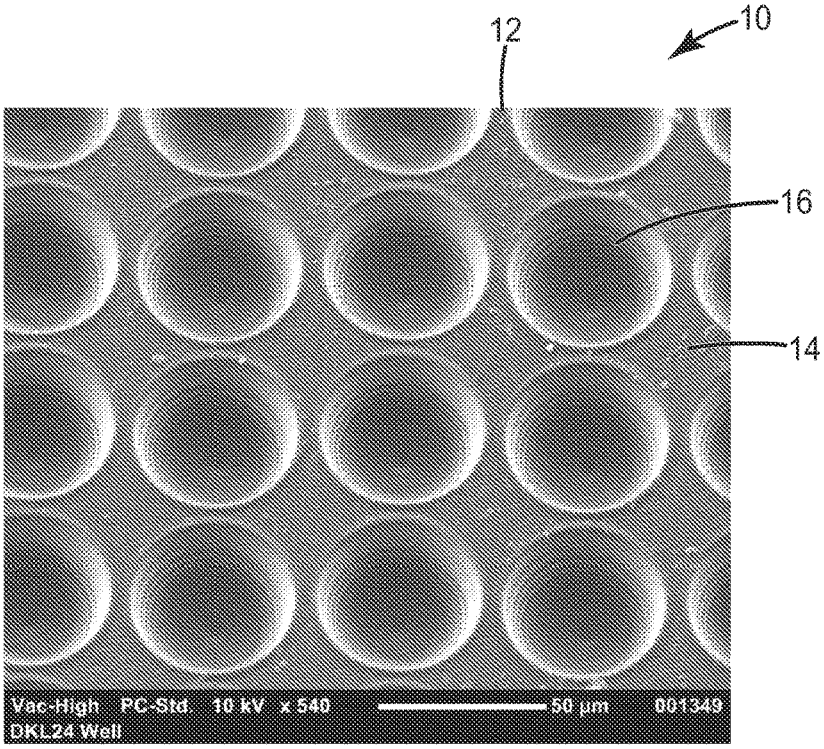
FIG. 8A is an SEM image of a portion of a polishing layer of a comparative polishing pad having only a plurality of precisely shaped pores.

FIG. 8A is a SEM image of polishing layer 10 of a comparative polishing. The polishing layer 10 includes working surface 12, which is a precisely engineered surface having precisely engineered topography. The working surface of FIG. 8A includes a plurality of precisely shaped pores 16 and land region 14. No precisely shaped asperities are present. The precisely shaped pores 16 are cylindrical in shape having a diameter of about 42 microns at the pore openings and a depth of about 30 microns. The precisely shaped pores 16 are arranged in a square array having a center to center distance of about 60 microns. The total cross-sectional area of the precisely shaped pore openings, i.e. the sum of the cross-sectional areas of the plurality of pore openings, is about 45% relative to the total projected surface area of the polishing pad.

Figure 8B:
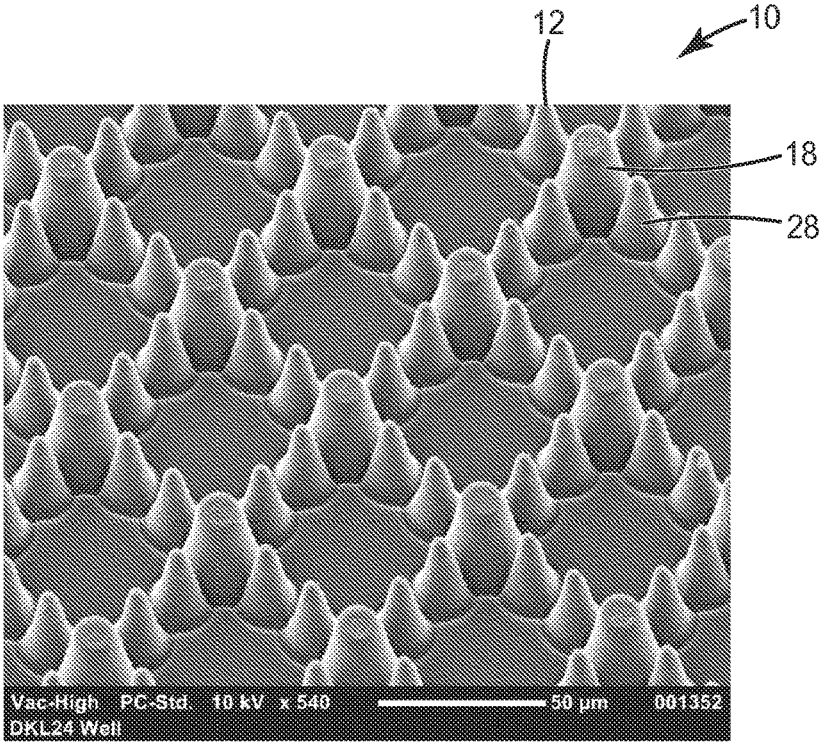
FIG. 8B is an SEM image of a portion of a polishing layer of a comparative polishing pad having only a plurality of precisely shaped asperities.

FIG. 8B is a SEM image of polishing layer 10 of a comparative polishing. The polishing layer 10 includes working surface 12, which is a precisely engineered surface having precisely engineered topography. The working surface of FIG. 8B includes a plurality of precisely shaped asperities 18 and 28 and land region 14. No precisely shaped pores are present. In this embodiment, two different sized cylindrical shaped asperities are used. The cylinders are somewhat tapered, due to the fabrication process. The larger size precisely shaped asperities 18 have a maximum diameter of about 20 micron and a height of about 20 micron. The smaller size precisely shaped asperities 28, positioned between precisely shaped asperities 18, have a maximum diameter of about 9 microns and a height of about 15 microns. The total cross-sectional area of the precisely shaped asperities 18 at their maximum diameters, i.e. the sum of the cross-sectional areas of the plurality of larger asperities at their maximum diameter, is about 7% relative to the total projected surface area of the polishing pad and the sum of the cross-sectional areas of the plurality of smaller asperities at their maximum diameter is about 5% relative to the total projected surface area of the polishing pad.

The polishing layer includes a land region having a thickness, Y. The thickness of the land region is not particularly limited. In some embodiments, the thickness of the land region is less than about 20 mm, less than about 10 mm, less than about 8 mm, less than about 5 mm, less than about 2.5 mm or even less than about 1 mm. This thickness of the land region may be greater than about 25 microns, greater than about 50 microns, greater than about 75 microns, greater than about 100 microns, greater than about 200 microns, greater than about 400 microns, greater than about 600 microns, greater than about 800 microns greater than about 1 mm, or even greater than about 2 mm.

The polishing layer may include at least one macro-channel or macro-grooves, e.g. macro-channel 19 of FIG. 1. The at least one macro-channel may provide improved polishing solution distribution, polishing layer flexibility as well as facilitate swarf removal from the polishing pad. Unlike pores, the macro-channels or macro-grooves do not allow fluid to be contained indefinitely within the macro-channel, fluid can flow out of the macro-channel during use of the pad. The macro-channels are generally wider and have a greater depth than the precisely shaped pores. As the thickness of the land region, Y, must be greater than the depth of the plurality of precisely shaped pores, the land region is generally of greater thickness than other abrasive articles known in the art that may have only asperities.

Having a thicker land region increases the polishing layer thickness. By providing one or more macro-channels with a secondary land region (defined by base 19*a*), having a lower thickness, Z, increased flexibility of the polishing layer may be obtained.

In some embodiments, at least a portion of the base of the at least one macro-channel include one or more secondary pores (not shown in FIG. 1), the secondary pore openings being substantially coplanar with base 19*a* of macro-channel 19. Generally, this type of polishing layer configuration may not be as efficient as others disclosed herein, as the secondary pores may be formed too far away from the distal ends of the precisely shape asperities. Subsequently, the polishing fluid contained in the pores may not be close enough to the interface between the distal ends of the precisely shaped asperities and the substrate being acted upon, e.g. a substrate being polished, and the polishing solution contained therein is less affective. In some embodiments, at least about 5%, at least about 10%, at last 30%, at least about 50%, at least about 70%, at least about 80%, at least about 90%, at least about 99% or even at least about 100% of the total surface area of the plurality of precisely shaped pore openings is not contained in the at least one macro-channel.

The width of the at least one macro-channel may be greater than about 10 microns, greater than about 50 microns or even greater than about 100 microns. The width of the macro-channels may be less than about 20 mm, less than about 10 mm, less than about 5 mm, less than about 2 mm, less than about 1 mm, less than about 500 microns or even less than about 200 microns. The depth of the at least one macro-channel may be greater than about 50 microns, greater than about 100 microns, greater than about 200 microns, greater than about 400 microns, greater than about 600 microns, greater than about 800 microns, greater than about 1 mm or even greater than about 2 mm. In some embodiments, the depth of the at least one macro-channels is no greater than the thickness of the land region. In some embodiments, the depth of at least a portion of the at least one macro-channel is less than the thickness of the land region adjacent the portion of the at least one macro-channel. The depth of the at least one macro-channel may be less than about 15 mm, less than about 10 mm, less than about 8 mm, less than about 5 mm, less than about 3 mm or even less than about 1 mm.

In some embodiments, the depth of at least a portion of the at least one macro-channel may be greater than the depth of at least a portion of the precisely shaped pores. In some embodiments, The depth of at least a portion of the at least one macro-channel may be greater than the depth of at least 5%, at least 10% at least 20%, at least 30% at least 50%, at least 70%, at least 80%, at least 90%, at least 95%, at least 99% or even at least 100% of the precisely shaped pores. In some embodiments, the width of at least a portion of the at least one macro-channel is greater than the width of at least a portion of the precisely shaped pores. In some embodiments, the width of at least a portion of the at least one macro-channel may be greater than the width of at least 5%, at least 10% at least 20%, at least 30% at least 50%, at least 70%, at least 80%, at least 90%, at least 95%, at least 99% or even at least 100% of the precisely shaped pores.

The ratio of the depth of the at least one macro-channel to the depth of the precisely shaped pores is not particularly limited. In some embodiments, the ratio of the depth of at least a portion of the at least one macro-channel to the depth of a portion of the precisely shaped pores may be greater than about 1.5, greater than about 2, greater than about 3, greater than about 5 greater than about 10, greater than about 15, greater than about 20 or even greater than about 25 and the ratio of the depth of at least a portion of the at least one macro-channel to the depth of at least a portion of the precisely shaped pores may be less than about 1000, less than about 500, less than about 250, less than about 100 or even less than about 50. In some embodiments, the ratio of the depth of at least a portion of the at least one macro-channel to the depth of a portion of the precisely shaped pores may be between about 1.5 and about 1000, between about 5 and 1000, between about 10 and about 1000, between about 15 and about 1000, between about 1.5 and 500, between about 5 and 500, between about 10 and about 500, between about 15 and about 500, between about 1.5 and 250, between about 5 and 250, between about 10 and about 250, between about 15 and about 250, between about 1.5 and 100, between about 5 and 100, between about 10 and about 100, between about 15 and about 100, between about 1.5 and 50, between about 5 and 50, between about 10 and about 50, and even between about 15 and about 5. The portion of precisely shaped pores to which these ratios applies may include at least 5%, at least 10% at least 20%, at least 30% at least 50%, at least 70%, at least 80%, at least 90%, at least 95%, at least 99% or even at least 100% of the precisely shaped pores.

The ratio of the width of the at least one macro-channel to the width of a pore is not particularly limited. In some embodiments, the ratio of the width of a portion of the at least one macro-channel to the width of a portion of the precisely shaped pores, e.g. the diameter if the pores have a circular cross-section with respect to the lateral dimension of the pad, may be greater than about 1.5, greater than about 2, greater than about 3, greater than about 5 greater than about 10, greater than about 15, greater than about 20 or even greater than about 25 and the ratio of the width of at least a portion of the at least one macro-channel to the width of at least a portion of the precisely shaped pores may be less than about 1000, less than about 500, less than about 250, less than about 100 or even less than about 50. In some embodiments, the ratio of the width of at least a portion of the at least one macro-channel to the width of a portion of the precisely shaped pores may be between about 1.5 and about 1000, between about 5 and 1000, between about 10 and about 1000, between about 15 and about 1000, between about 1.5 and 500, between about 5 and 500, between about 10 and about 500, between about 15 and about 500, between about 1.5 and 250, between about 5 and 250, between about 10 and about 250, between about 15 and about 250, between about 1.5 and 100, between about 5 and 100, between about 10 and about 100, between about 15 and about 100, between about 1.5 and 50, between about 5 and 50, between about 10 and about 50, and even between about 15 and about 5. The portion of precisely shaped pores to which these ratios applies may include at least 5%, at least 10% at least 20%, at least 30% at least 50%, at least 70%, at least 80%, at least 90%, at least 95%, at least 99% or even at least 100% of the precisely shaped pores.

Figure 9:
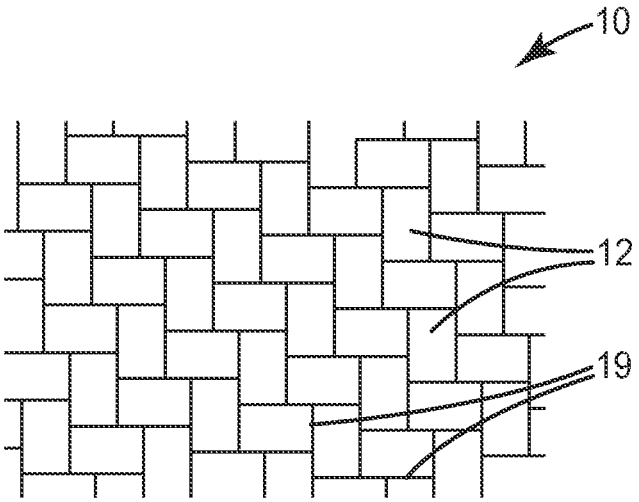
FIG. 9 is a top view schematic diagram of a portion of a polishing layer in accordance with some embodiments of the present disclosure.

The macro-channels may be formed into the polishing layer by any known techniques in the art including, but not limited to, machining, embossing and molding. Due to improved surface finish on the polishing layer (which helps minimize substrate defects, e.g. scratches, during use) embossing and molding are preferred. In some embodiments, the macro-channels are fabricated in the embossing process used to form the precisely shaped pores and/or asperities. This is achieved by forming their negative, i.e. raised regions, in the master tool, with the macro-channels themselves then being formed in the polishing layer during embossing. This is of particular advantage, as the precisely shaped asperities, precisely shaped pores and macro-channels may all be fabricated into the polishing layer in a single process step, leading to cost and time savings. The macro-channels can be fabricated to form various patterns known in the art, including but not limited to concentric rings, parallel lines, radial lines, a series of lines forming a grid array, spiral and the like. Combinations of differing patterns may be used. FIG. 9 shows a top view schematic diagram of a portion of a polishing layer 10 in accordance with some embodiments of the present disclosure. Polishing layer 10 includes working surfaces 12 and macro-channels 19. The macro-channels are provided in a herringbone pattern. The herringbone pattern of FIG. 9 is similar to that which was formed in the polishing layer 10 shown in FIG. 7. With respect to FIG. 7, the herringbone pattern formed by the macro-channels 19 creates rectangular "cell" sizes, i.e. areas of working surfaces 12, of about 2.5 mm×4.5 mm. The macro-channels provide a secondary land region corresponding to macro-channel base 19*a* (FIG. 1). The secondary land region has a lower thickness, Z, than land region 14 and facilitates the ability of individual regions or "cells" of working surfaces 12 (see FIGS. 7 and 9) to move independently in the vertical direction. This may improve local planarization during polishing.

The working surface of the polishing layer may further include nanometer-size topographical features on the surface of the polishing layer. As used herein, "nanometer-size topographical features" refers to regularly or irregularly shaped domains having a length or longest dimension no greater than about 1,000 nm. In some embodiments, the precisely shaped asperities, the precisely shaped pores, the land region, secondary land region or any combination thereof includes nanometer-size topographical features on their surface. In one embodiment, the precisely shaped asperities, the precisely shaped pores and the land region include nanometer-size topographical features on their surfaces. It is thought that this additional topography increases the hydrophilic properties of the pad surface, which is believed to improve slurry distribution, wetting and retention across the polishing pad surface. The nanometer-size topographical features can be formed by any known method in the art, including, but not limited to, plasma processing, e.g. plasma etching, and wet chemical etching, Plasma processes include processes described in U.S. Pat. No. 8,634,146 (David, et. al.) and U.S. Provisional Appl. No. 61/858,670 (David, et. al.), which are incorporated herein by reference in their entirety. In some embodiments, the nanometer-size features may be regularly shaped domains, i.e. domains with a distinct shape such as circular, square, hexagonal and the like, or the nanometer-size features may be irregularly shaped domains. The domains may be arranged in a regular array, e.g. hexagonal array or square array, or they may be in a random array. In some embodiments, the nanometer-size topographical features on the working surface of the polishing layer may be a random array of irregularly shaped domains. The length scale of the domains, i.e. the longest dimension of the domains, may be less than about 1,000 nm, less than about 500 nm, less than about 400 nm, less than about 300 nm, less than about 250 nm, less than about 200 nm, less than about 150 nm or even less than about 100 nm. The length scale of the domains may be greater than about 5 nm, greater than about 10 nm, greater than about 20 nm or even greater than about 40 nm. The height of the domains may be less than about 250 nm, less than about 100 nm, less than about 80 nm, less than about 60 nm or even less than about 40 nm. The height of the domains may be greater than about 0.5 nm, greater than about 1 nm, greater than about 5 nm, greater than about 10 nm or even greater than about 20 nm. In some embodiments, the nanometer-sized features on the working surface of the polishing layer include regular or irregularly shaped grooves, separating the domains. The width of the grooves may be less than about 250 nm, less than about 200 nm, less than about 150 nm, less than about 100 nm, less than about 80 nm, less than about 60 nm or even less than about 40 nm. The width of the grooves may be greater than about 1 nm, greater than about 5 nm, greater than about 10 nm or even greater than about 20 nm. The depth of the grooves may be less than about 250 nm, less than about 100 nm, less than about 80 nm, less than about 60 nm, less than about 50 nm or even less than about 40 nm. The depth of the grooves may be greater than about 0.5 nm, greater than about 1 nm, greater than about 5 nm, greater than about 10 nm or even greater than about 20 nm. The nanometer-size topographical features are considered to be non-regenerating, i.e. they cannot be formed or reformed by either the polishing process or a conventional conditioning process, e.g. use of a diamond pad conditioner in a conventional CMP conditioning process.

The nanometer-size topographical features may change the surface properties of the polishing layer. In some embodiments, the nanometer-size topographical features increase the hydrophilicity, i.e. the hydrophilic properties, of the polishing layer. The nanometer-size topographical features may include a hydrophilic surface at the top surface of the features and a hydrophobic surface at the base of the grooves of the nanometer-size topographical features. One of the benefits of including the nanometer-size topographical features on the precisely shaped asperity surfaces as well as the precisely shaped pore surfaces, land region and/or secondary land region surfaces is that, if the nanometer-size topographical features are worn away from the surface of the asperities during the polishing process, the positive benefits of the nanometer-size topographical features, which include increasing the hydrophilic properties across the pad surface, i.e. working surface of the polishing layer, can be maintained, as the nanometer-size topographical features will not be worn away from the precisely shaped pore surfaces and/or land region surfaces during polishing. Thus, a polishing layer can be obtained having the surprising effect of good surface wetting characteristics even though the precisely shaped asperities surfaces in contact with the substrate being polished, i.e. the precisely shaped asperities' distal ends, may have poor wetting characteristics. As such, it may be desirable to reduce the total surface area of the distal ends of the precisely shaped asperities relative to the surface area of the precisely shaped pore openings, and/or land region. Another benefit of including the nanometer-size topographical features on the precisely shaped asperity surfaces, the precisely shaped pore surfaces, land region and/or secondary land region surfaces is that the width of the grooves of the nanometer-size topographical features may be on the order of the size of some slurry particles used in CMP polishing solutions and thus may enhance polishing performance by retaining some of the slurry particles within the grooves and subsequently within the working surface of the polishing layer.

In some embodiments, the ratio of the surface area of the distal ends of the precisely shaped asperities to the surface area of the precisely shaped pore openings is less than about 4, less than about 3, less than about 2, less than about 1, less than about 0.07, less than about 0.5, less than about 0.4, less than about 0.3, less than about 0.25, less than about 0.20, less than about 0.15, less than about 0.10, less than about 0.05, less than about 0.025, less than about 0.01 or even less than about 0.005. In some embodiments, the ratio of the surface area of the distal ends of the precisely shaped asperities to the surface area of the precisely shaped pore openings may be greater than about 0.0001, greater than about 0.0005, greater than about 0.001, greater than about 0.005, greater than about 0.01, greater than about 0.05 or even greater than about 0.1. In some embodiments, the ratio of the surface area of the asperity bases of the precisely shaped asperities to the surface area of the precisely shaped pore openings is the same as described for the ratio of the surface area of the distal ends of the precisely shaped asperities to the surface area of the precisely shaped pore openings.

In some embodiments the ratio of the surface area of the distal ends of the precisely shaped asperities to the total projected polishing pad surface area is less than about 4 less than about 3, less than about 2, less than about 1, less than about 0.7, less than about 0.5, less than about 0.4, less than about 0.3, less than about 0.25, less than about 0.2, less than about 0.15, less than about 0.1, less than about 0.05, less than about 0.03, less than about 0.01, less than about 0.005 or even less than about 0.001. In some embodiments, the ratio of the surface area of the distal ends of the precisely shaped asperities to the total projected polishing pad surface area may be greater than about 0.0001, greater than about 0.0005, greater than about 0.001, greater than about 0.005, greater than about 0.01, greater than about 0.05 or even greater than about 0.1. In some embodiments, the ratio of the surface area of the distal ends of the precisely shaped asperities to the total projected polishing pad surface area may be between about 0.0001 and about 4, between about 0.0001 and about 3, between about 0.0001 and about 2, between about 0.0001 and about 1, between about 0.0001 and about 0.7, between about 0.0001 and about 0.5, between about 0.0001 and about 0.3, between about 0.0001 and about 0.2, between about 0.0001 and about 0.1, between about 0.0001 and about 0.05, between about 0.0001 and about 0.03, between about 0.001 and about 2, between about 0.001 and about 1, between about 0.001 and about 0.5, between about 0.001 and about 0.2, between about 0.001 and about 0.1, between about 0.001 and about 0.05, between about 0.001 and about 0.2, between about 0.001 and about 0.1, between about 0.001 and about 0.05 and even between about 0.001 and about 0.03. In some embodiments, the ratio of the surface area of the asperity bases of the precisely shaped asperities to the total projected surface area of the polishing pad is the same as described for the ratio of the surface area of the distal ends of the precisely shaped asperities to the total projected surface area of the polishing pad.

In some embodiments, the ratio of the surface area of the distal ends of the precisely shaped asperities to the surface area of the land region is less than about 0.5, less than about 0.4, less than about 0.3, less than about 0.25, less than about 0.20, less than about 0.15, less than about 0.10, less than about 0.05, less than about 0.025 or even less than about 0.01; greater than about 0.0001, greater than about 0.001 or even greater than about 0.005. In some embodiments, the ratio of the surface area of the distal ends of the precisely shaped asperities to the projected surface area of the precisely shaped pores and the surface area of the land region is less than about 0.5, less than about 0.4, less than about 0.3, less than about 0.25, less than about 0.20, less than about 0.15, less than about 0.10, less than about 0.05, less than about 0.025 or even less than about 0.01; greater than about 0.0001, greater than about 0.001 or even greater than about 0.005. In some embodiments, the ratio of the surface area of the asperity bases of the precisely shaped asperities to the surface area of the land region is the same as described for the ratio of the surface area of the distal ends of the precisely shaped asperities to the surface area of the land region.

In some embodiments the ratio of the surface area of the distal ends of the precisely shaped asperities to the total projected polishing pad surface area is less than about 4 less than about 3, less than about 2, less than about 1, less than about 0.7, less than about 0.5, less than about 0.4, less than about 0.3, less than about 0.25, less than about 0.2, less than about 0.15, less than about 0.1, less than about 0.05, less than about 0.03, less than about 0.01, less than about 0.005 or even less than about 0.001. In some embodiments the ratio of the surface area of the distal ends of the precisely shaped asperities to the total projected polishing pad surface area may be greater than about 0.0001, greater than about 0.0005, greater than about 0.001, greater than about 0.005, greater than about 0.01, greater than about 0.05 or even greater than about 0.1. In some embodiments the ratio of the surface area of the distal ends of the precisely shaped asperities to the total projected polishing pad surface area may be between about 0.0001 and about 4, between about 0.0001 and about 3, between about 0.0001 and about 2, between about 0.0001 and about 1, between about 0.0001 and about 0.7, between about 0.0001 and about 0.5, between about 0.0001 and about 0.3, between about 0.0001 and about 0.2, between about 0.0001 and about 0.1, between about 0.0001 and about 0.05, between about 0.0001 and about 0.03, between about 0.001 and about 2, between about 0.001 and about 0.1, between about 0.001 and about 0.5, between about 0.001 and about 0.2, between about 0.001 and about 0.1, between about 0.001 and about 0.05 and even between about 0.001 and about 0.03.

Figure 1B:
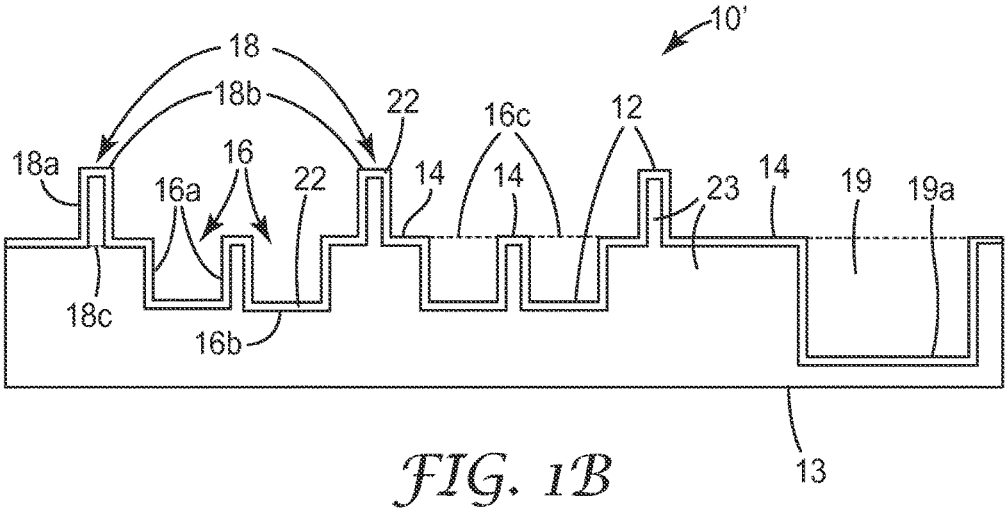
FIG. 1B is a schematic cross-sectional diagram of a portion of a polishing layer, in accordance with some embodiments of the present disclosure.

In some embodiments, surface modification techniques, which may include the formation of nanometer-size topographical features, may be used to chemically alter or modify the working surface of the polishing layer. The portion of the working surface of the polishing layer that is modified, e.g. that includes nanometer size topographical features, may be referred to as a secondary surface layer. The remaining portion of the polishing layer that is unmodified may be referred to as a bulk layer. FIG. 1B shows a polishing layer 10' which is nearly identical to that of FIG. 1A, except the polishing layer 10' includes a secondary surface layer 22 and corresponding bulk layer 23. In this embodiment, the working surface includes a secondary surface layer 22, i.e. the region of the surface that has been chemically altered, and a bulk layer 23, i.e. the region of the working surface adjacent the secondary surface layer which has not been chemically altered. As shown in FIG. 1B, the distal ends 18*b* of precisely shaped asperities 18 are modified to include secondary surface layer 22. In some embodiments, the chemical composition in at least a portion of the secondary surface layer 22 differs from the chemical composition within the bulk layer 23, e.g. the chemical composition of the polymer in at least a portion of the outer most surface of the working surface is modified, while the polymer beneath this modified surface has not been modified. Surface modifications may include those known in the art of polymer surface modification, including chemical modification with various polar atoms, molecules and/or polymers. In some embodiments, the chemical composition in at least a portion of the secondary surface layer 22 which differs from the chemical composition within the bulk layer 23 includes silicon. The thickness, i.e. height, of the secondary surface layer 22 is not particularly limited, however, it may be less than the height of the precisely shaped features. In some embodiments, the thickness of the secondary surface layer may be less than about 250 nm, less than about 100 nm, less than about 80 nm, less than about 60 nm, less than about 40 nm, less than about 30 nm, less than about 25 nm or even less than about 20 nm. The thickness of the secondary surface layer may be greater than about 0.5 nm, greater than about 1 nm, greater than about 2.5 nm, greater than about 5 nm, greater than about 10 nm or even greater than about 15 nm. In some embodiments, the ratio of the thickness of the secondary surface layer to the height of the precisely shaped asperities may be less than about 0.3, less than about 0.2, less than about 0.1, less than about 0.05, less than about 0.03 or even less than about 0.01; greater than about 0.0001 or even greater than about 0.001. If the precisely shaped asperities include asperities having more than one height, then the height of the tallest precisely shaped asperity is used to define the above ratio. In some embodiments greater than about 30%, greater than about 40%, greater than about 50%, greater than 60%, greater than about 70%, greater than about 80%, greater than about 90%, greater than about 95% or even about 100% of the surface area of the polishing layer includes a secondary surface layer.

In some embodiments, the thickness of the surface layer is included in the polishing layer dimensions, e.g. pore and asperity dimensions (width, length, depth and height), polishing layer thickness, land region thickness, secondary land region thickness, macro-channel depth and width.

In some embodiments, the precisely shaped asperities, the precisely shaped pores, the land region, secondary land region or any combination thereof includes a secondary surface layer. In one embodiment, the precisely shaped asperities, the precisely shaped pores and the land region include a secondary surface layer.

Figure 1C:
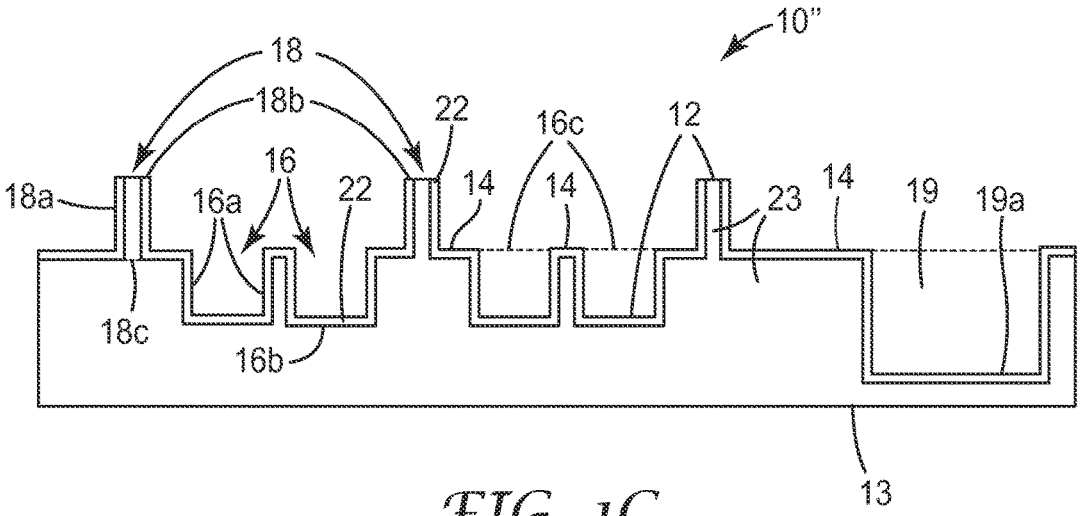
FIG. 1C is a schematic cross-sectional diagram of a portion of a polishing layer, in accordance with some embodiments of the present disclosure.

FIG. 1C shows a polishing layer 10" which is nearly identical to that of FIG. 1B, except the distal ends 18*b* of precisely shaped asperities 18 of polishing layer 10" do not include secondary surface layer 22. Precisely shaped asperities without secondary surface layer 22 on the distal ends 18*b* of precisely shaped asperities 18 may be formed by masking the distal ends during the surface modification technique, using known masking techniques, or may be produced by first forming the secondary surface layer 22 on the distal ends 18*b* of precisely shaped asperities 18, as shown in FIG. 1B, and then removing the secondary surface layer 22 only from the distal ends 18*b* by a pre-dressing process (a dressing process conducted prior to using the polishing layer for polishing) or by an in-situ dressing process (a dressing process conducted on the polishing layer during or by the actual polishing process).

In some embodiments, the working surface of the polishing layer includes precisely shaped asperities, precisely shaped pores and land region, with optional secondary land region, wherein the working surface further includes a secondary surface layer and a bulk layer and, the distal ends of at least a portion of the precisely shaped asperities do not include a secondary surface layer. In some embodiments, at least about 30%, at least about 50%, at least about 70%, at least about 90%, at least about 95% or even about 100% of the distal ends of the precisely shaped asperities do not include a secondary surface layer.

The secondary surface layer may include nanometer-size topographical features. In some embodiments, the working surface of the polishing layer includes precisely shaped asperities, precisely shaped pores and land region, with optional secondary land region, wherein the working surface further includes nanometer-size topographical features and the distal ends of at least a portion of the precisely shaped asperities do not include nanometer-size topographical features. In some embodiments, at least about 30%, at least about 50%, at least about 70, at least about 90%, at least about 95% or even about 100% of the distal ends of the precisely shaped asperities do not include nanometer-size topographical features. Precisely shaped asperities without nanometer-size topographical features on the distal ends of the precisely shaped asperities may be formed by masking the distal ends during the surface modification technique, using known masking techniques, or may be produced by first forming nanometer-size topographical features on the distal ends of the precisely shaped asperities and then removing the nanometer-size topographical features only from the distal ends by a pre-dressing process or by an in-situ dressing process. In some embodiments, the ratio of the height of the domains of the nanometer-size topographical features to the height of the precisely shaped asperities may be less than about 0.3, less than about 0.2, less than about 0.1, less than about 0.05, less than about 0.03 or even less than about 0.01; greater than about 0.0001 or even greater than about 0.001. If the precisely shaped asperities include asperities having more than one height, then the height of the tallest precisely shaped asperity is used to define the above ratio.

In some embodiments, the surface modifications result in a change in the hydrophobicity of the working surface. This change can be measured by various techniques, including contact angle measurements. In some embodiments, the contact angle of the working surface, after surface modification, decreases compared to the contact angle prior to the surface modification. In some embodiments, at least one of the receding contact angle and advancing contact angle of the secondary surface layer is less than the corresponding receding contact angle or advancing contact angle of the bulk layer, i.e. the receding contact angle of the secondary surface layer is less than the receding contact angle of the bulk layer and/or the advancing contact angle of the secondary surface layer is less than the advancing contact angle of the bulk layer. In other embodiments, at least one of the receding contact angle and advancing contact angle of the secondary surface layer is at least about 10° less than, at least about 20° less than, at least about 30° less than or even at least about 40° less than the corresponding receding contact angle or advancing contact angle of the bulk layer. For example, in some embodiments, the receding contact angle of the secondary surface layer is at least about 10° less than, at least about 20° less than, at least about 30° less than or even at least about 40° less than the receding contact angle of the bulk layer. In some embodiments, the receding contact angle of the working surface is less than about 50°, less than about 45°, less than about 40°, less than about 35°, less than about 30°, less than about 25°, less than about 20°, less than about 15°, less than about 10° or even less than about 5°. In some embodiments, the receding contact angle of the working surface is about 0°. In some embodiments the receding contact angle may be between about 0° and about 50°, between about 0° and about 45°, between about 0° and about 40°, between about 0° and about 35°, between about 0° and about 30°, between about 0° and about 25°, between about 0° and about 20°, between about 0° and about 15°, between about 0° and about 10°, or even between about 0° and about 5° In some embodiments, the advancing contact angle of the working surface is less than about 140°, less than about 135°, less than about 130°, less than about 125°, less than about 120° or even less than about 115°. Advancing and receding contact angle measurement techniques are known in the art and such measurements may be made, for example, per the "Advancing and Receding Contact Angle Measurement Test Method" described herein.

One particular benefit of including nanometer-sized features in the working surface of the polishing layer is that polymers with high contact angles, i.e. hydrophobic polymers, may be used to fabricate the polishing layer and yet the working surface can be modified to be hydrophilic, which aides in polishing performance, particularly when the working fluid used in the polishing process is aqueous based. This enables the polishing layer to be fabricated out of a large variety of polymers, i.e. polymers that may have outstanding toughness; which reduces the wear of the polishing layer, particularly the precisely shaped asperities; yet have undesirably high contact angles, i.e. they are hydrophobic. Thus, a polishing layer can be obtain having the surprising synergistic effect of both long pad life and good surface wetting characteristics of the working surface of the polishing layer, which creates improve overall polishing performance.

Figure 10A:
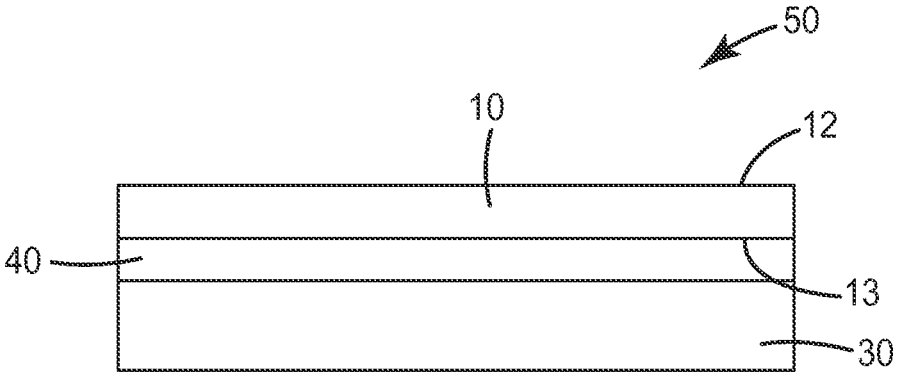
FIG. 10A is a schematic cross sectional diagram of a polishing pad in accordance with some embodiments of the present disclosure.

The polishing layer, by itself, may function as a polishing pad. The polishing layer may be in the form of a film that is wound on a core and employed in a "roll to roll" format during use. The polishing layer may also be fabricated into individual pads, e.g. a circular shaped pad, as further discussed below. According to some embodiments of the present disclosure, the polishing pad, which includes a polishing layer, may also include a subpad. FIG. 10A shows a polishing pad 50 which includes a polishing layer 10, having a working surface 12 and second surface 13 opposite working surface 12, and a subpad 30 adjacent to second surface 13. Optionally, a foam layer 40 is interposed between the second surface 13 of the polishing layer 10 and the subpad 30. The various layers of the polishing pad can be adhered together by any techniques known in the art, including using adhesives, e.g. pressure sensitive adhesives (PSAs), hot melt adhesives and cure in place adhesives. In some embodiments, the polishing pad includes an adhesive layer adjacent to the second surface. Use of a lamination process in conjunction with PSAs, e.g. PSA transfer tapes, is one particular process for adhering the various layers of polishing pad 50. Subpad 30 may be any of those known in the art. Subpad 30 may be a single layer of a relatively stiff material, e.g. polycarbonate, or a single layer of a relatively compressible material, e.g. an elastomeric foam. The subpad 30 may also have two or more layers and may include a substantially rigid layer (e.g. a stiff material or high modulus material like polycarbonate, polyester and the like) and a substantially compressible layer (e.g. an elastomer or an elastomeric foam material). Foam layer 40 may have a durometer from between about 20 Shore D to about 90 Shore D. Foam layer 40 may have a thickness from between about 125 micron and about 5 mm or even between about 125 micron and about a 1000 micron.

In some embodiments of the present disclosure, which include a subpad having one or more opaque layers, a small hole may be cut into the subpad creating a "window". The hole may be cut through the entire subpad or only through the one or more opaque layers. The cut portion of the supbad or one or more opaque layers is removed from the subpad, allowing light to be transmitted through this region. The hole is pre-positioned to align with the endpoint window of the polishing tool platen and facilitates the use of the wafer endpoint detection system of the polishing tool, by enabling light from the tool's endpoint detection system to travel through the polishing pad and contact the wafer. Light based endpoint polishing detection systems are known in the art and can be found, for example, on MIRRA and REFLEXION LK CMP polishing tools available from Applied Materials, Inc., Santa Clara, Calif. Polishing pads of the present disclosure can be fabricated to run on such tools and endpoint detection windows which are configured to function with the polishing tool's endpoint detection system can be included in the pad. In one embodiment, a polishing pad including any one of the polishing layers of the present disclosure can be laminated to a subpad. The subpad includes at least one stiff layer, e.g. polycarbonate, and at least one compliant layer, e.g. an elastomeric foam, the elastic modulus of the stiff layer being greater than the elastic modulus of the compliant layer. The compliant layer may be opaque and prevent light transmission required for endpoint detection. The stiff layer of the subpad is laminated to the second surface of the polishing layer, typically through the use of a PSA, e.g. transfer adhesive or tape. Prior to or after lamination, a hole may be die cut, for example, by a standard kiss cutting method or cut by hand, in the opaque compliant layer of the subpad. The cut region of the compliant layer is removed creating a "window" in the polishing pad. If adhesive residue is present in the hole opening, it can be removed, for example, through the use of an appropriate solvent and/or wiping with a cloth or the like. The "window" in the polishing pad is configured such that, when the polishing pad is mounted to the polishing tool platen, the window of the polishing pad aligns with the endpoint detection window of the polishing tool platen. The dimensions of the hole may be, for example, up to 5 cm wide by 20 cm long. The dimensions of the hole are, generally, the same or similar in dimensions as the dimensions of the endpoint detection window of the platen.

The polishing pad thickness is not particularly limited. The polishing pad thickness may coincide with the required thickness to enable polishing on the appropriate polishing tool. The polishing pad thickness may be greater than about 25 microns, greater than about 50 microns, greater than about 100 microns or even greater than 250 microns; less than about 20 mm, less than about 10 mm, less than about 5 mm or even less than about 2.5 mm. The shape of the polishing pad is not particularly limited. The pads may be fabricated such that the pad shape coincides with the shape of the corresponding platen of the polishing tool the pad will be attached to during use. Pad shapes, such as circular, square, hexagonal and the like may be used. A maximum dimension of the pad, e.g. the diameter for a circular shaped pad, is not particularly limited. The maximum dimension of a pad may be greater than about 10 cm, greater than about 20 cm, greater than about 30 cm, greater than about 40 cm, greater than about 50 cm, greater than about 60 cm; less than about 2.0 meter, less than about 1.5 meter or even less than about 1.0 meter. As discussed above, the pad, including any one of polishing layer, the subpad, the optional foam layer and any combination thereof, may include a window, i.e. a region allowing light to pass through, to enable standard endpoint detection techniques used in polishing processes, e.g. wafer endpoint detection.

In some embodiments, the polishing layer includes a polymer. Polishing layer 10 may be fabricated from any known polymer, including thermoplastics, thermoplastic elastomers (TPEs), e.g. TPEs based on block copolymers, thermosets, e.g. elastomers and combinations thereof. If an embossing process is being used to fabricate the polishing layer 10, thermoplastics and TPEs are generally utilized for polishing layer 10. Thermoplastics and TPEs include, but are not limited to polyurethanes; polyalkylenes, e.g. polyethylene and polypropylene; polybutadiene, polyisoprene; polyalkylene oxides, e.g. polyethylene oxide; polyesters; polyamides; polycarbonates, polystyrenes, block copolymers of any of the proceeding polymers, and the like, including combinations thereof. Polymer blends may also be employed. One particularly useful polymer is a thermoplastic polyurethane, available under the trade designation ESTANE 58414, available from Lubrizol Corporation, Wickliffe, Ohio. In some embodiments, the composition of the polishing layer may be at least about 30%, at least about 50%, at least about 70%, at least about 90%, at least about 95%, at least about 99% or even at least about 100% polymer by weight.

In some embodiments, the polishing layer may be a unitary sheet. A unitary sheet includes only a single layer of material (i.e. it is not a multi-layer construction, e.g. a laminate) and the single layer of material has a single composition. The composition may include multiple-components, e.g. a polymer blend or a polymer-inorganic composite. Use of a unitary sheet as the polishing layer may provide cost benefits, due to minimization of the number of process steps required to form the polishing layer. A polishing layer that includes a unitary sheet may be fabricated from techniques know in the art, including, but not limited to, molding and embossing. Due to the ability to form a polishing layer having precisely shaped, asperities, precisely shaped pores and, optionally, macro-channels in a single step, a unitary sheet is preferred.

The hardness and flexibility of polishing layer 10 is predominately controlled by the polymer used to fabricate it. The hardness of polishing layer 10 is not particularly limited. The hardness of polishing layer 10 may be greater than about 20 Shore D, greater than about 30 Shore D or even greater than about 40 Shore D. The hardness of polishing layer 10 may be less than about 90 Shore D, less than about 80 Shore D or even less than about 70 Shore D. The hardness of polishing layer 10 may be greater than about 20 Shore A, greater than about 30 Shore A or even greater than about 40 Shore A. The hardness of polishing layer 10 may be less than about 95 Shore A, less than about 80 Shore A or even less than about 70 Shore A. The polishing layer may be flexible. In some embodiments the polishing layer is capable of being bent back upon itself producing a radius of curvature in the bend region of less than about 10 cm, less than about 5 cm, less than about 3 cm, or even less than about 1 cm; and greater than about 0.1 mm, greater than about, 0.5 mm or even greater than about 1 mm. In some embodiments the polishing layer is capable of being bent back upon itself producing a radius of curvature in the bend region of between about 10 cm and about 0.1 mm, between about 5 cm and bout 0.5 mm or even between about 3 cm and about 1 mm.

To improve the useful life of polishing layer 10, it is desirable to utilize polymeric materials having a high degree of toughness. This is particularly important, due to the fact the precisely shaped asperities are small in height yet need to perform for a significantly long time to have a long use life. The use life may be determined by the specific process in which the polishing layer is employed. In some embodiments, the use life time is at least about 30 minutes at least 60 minutes, at least 100 minute, at least 200 minutes, at least 500 minutes or even at least 1000 minutes. The use life may be less than 10000 minutes, less than 5000 minutes or even less than 2000 minutes. The useful life time may be determined by measuring a final parameter with respect to the end use process and/or substrate being polished. For example, use life may be determined by having an average removal rate or having a removal rate consistency (as measure by the standard deviation of the removal rate) of the substrate being polished over a specified time period (as defined above) or producing a consistent surface finish on a substrate over a specified time period. In some embodiments, the polishing layer can provide a standard deviation of the removal rate of a substrate being polished that is between about 0.1% and 20%, between about 0.1% and about 15%, between about 0.1% and about 10%, between about 0.1% and about 5% or even between about 0.1% and about 3% over a time period from of, at least about 30 minutes, at least about 60 minutes, at least about 100 minutes at least about 200 minutes or even at least about 500 minutes. The time period may be less than 10000 minutes. To achieve this, it is desirable to use polymeric materials having a high work to failure (also known as Energy to Break Stress), as demonstrated by having a large integrated area under a stress vs. strain curve, as measured via a typical tensile test, e.g. as outlined by ASTM D638. High work to failure may correlate to lower wear materials. In some embodiments, the work to failure is greater than about 3 Joules, greater than about 5 Joules, greater than about 10 Joules, greater than about 15 joules greater than about 20 Joules, greater than about 25 Joules or even greater than about 30 Joules. The work to failure may be less than about 100 Joules or even less than about 80 Joules.

The polymeric materials used to fabricate polishing layer 10 may be used in substantially pure form. The polymeric materials used to fabricate polishing layer 10 may include fillers known in the art. In some embodiments, the polishing layer 10 is substantially free of any inorganic abrasive material (e.g. inorganic abrasive particles), i.e. it is an abrasive free polishing pad. By substantially free it is meant that the polishing layer 10 includes less than about 10% by volume, less than about 5% by volume, less than about 3% by volume, less than about 1% by volume or even less than about 0.5% by volume inorganic abrasive particles. In some embodiments, the polishing layer 10 contains substantially no inorganic abrasive particles. An abrasive material may be defined as a material having a Mohs hardness greater than the Mohs hardness of the substrate being abraded or polished. An abrasive material may be defined as having a Mohs hardness greater than about 5.0, greater than about 5.5, greater than about 6.0, greater than about 6.5, greater than about 7.0, greater than about 7.5, greater than about 8.0 or even greater than about 9.0. The maximum Mohs hardness is general accepted to be 10. The polishing layer 10 may be fabricated by any techniques known in the art. Microreplication techniques are disclosed in U.S. Pat. Nos. 6,285,001; 6,372,323; 5,152,917; 5,435,816; 6,852,766; 7,091,255 and U.S. Patent Application Publication No. 2010/0188751, all of which are incorporated by reference in their entirety.

In some embodiments, the polishing layer 10 is formed by the following process. First, a sheet of polycarbonate is laser ablated according to the procedures described in U.S. Pat. No. 6,285,001, forming the positive master tool, i.e. a tool having about the same surface topography as that required for polishing layer 10. The polycarbonate master is then plated with nickel using conventional techniques forming a negative master tool. The nickel negative master tool may then be used in an embossing process, for example, the process described in U.S. Patent Application Publication No. 2010/0188751, to form polishing layer 10. The embossing process may include the extrusion of a thermoplastic or TPE melt onto the surface of the nickel negative and, with appropriate pressure, the polymer melt is forced into the topographical features of the nickel negative. Upon cooling the polymer melt, the solid polymer film may be removed from the nickel negative, forming polishing layer 10 with working surface 12 having the desired topographical features, i.e. precisely shaped pores 16 and precisely shaped asperities 18 (FIG. 1A). If the negative includes the appropriate negative topography that corresponds to a desired pattern of macro-channels, macro-channels may be formed in the polishing layer 10 via the embossing process.

In some embodiments, the working surface 12 of polishing layer 10 may further include nanometer-size topographical features on top of the topography formed during the micro-replication process. Processes for forming these additional features are disclosed in U.S. Pat. No. 8,634,146 (David, et. al.) and U.S. Provisional Appl. No. 61/858,670 (David, et. al.), which have previously been incorporated by reference.

In another embodiment the present disclosure relates to a polishing system, the polishing system includes any one of the previous polishing pads and a polishing solution. The polishing pads may include any of the previous disclosed polishing layers 10. The polishing solutions used are not particularly limited and may be any of those known in the art. The polishing solutions may be aqueous or non-aqueous. An aqueous polishing solution is defined as a polishing solution having a liquid phase (does not include particles, if the polishing solution is a slurry) that is at least 50% by weight water. A non-aqueous solution is defined as a polishing solution having a liquid phase that is less than 50% by weight water. In some embodiments, the polishing solution is a slurry, i.e. a liquid that contains organic or inorganic abrasive particles or combinations thereof. The concentration of organic or inorganic abrasive particles or combination thereof in the polishing solution is not particularly limited. The concentration of organic or inorganic abrasive particles or combinations thereof in the polishing solution may be, greater than about 0.5%, greater than about 1%, greater than about 2%, greater than about 3%, greater than about 4% or even greater than about 5% by weight; may be less than about 30%, less than about 20% less than about 15% or even less than about 10% by weight. In some embodiments, the polishing solution is substantially free of organic or inorganic abrasive particles. By "substantially free of organic or inorganic abrasive particles" it is meant that the polishing solution contains less than about 0.5%, less than about 0.25%, less than about 0.1% or even less than about 0.05% by weight of organic or inorganic abrasive particles. In one embodiment, the polishing solution may contain no organic or inorganic abrasive particles. The polishing system may include polishing solutions, e.g. slurries, used for silicon oxide CMP, including, but not limited to shallow trench isolation CMP; polishing solutions, e.g. slurries, used for metal CMP, including, but not limited to, tungsten CMP, copper CMP and aluminum CMP; polishing solutions, e.g. slurries, used for barrier CMP, including but not limited to tantalum and tantalum nitride CMP and polishing solutions, e.g. slurries, used for polishing hard substrates, such as, sapphire. The polishing system may further include a substrate to be polished or abraded.

Figure 10B:
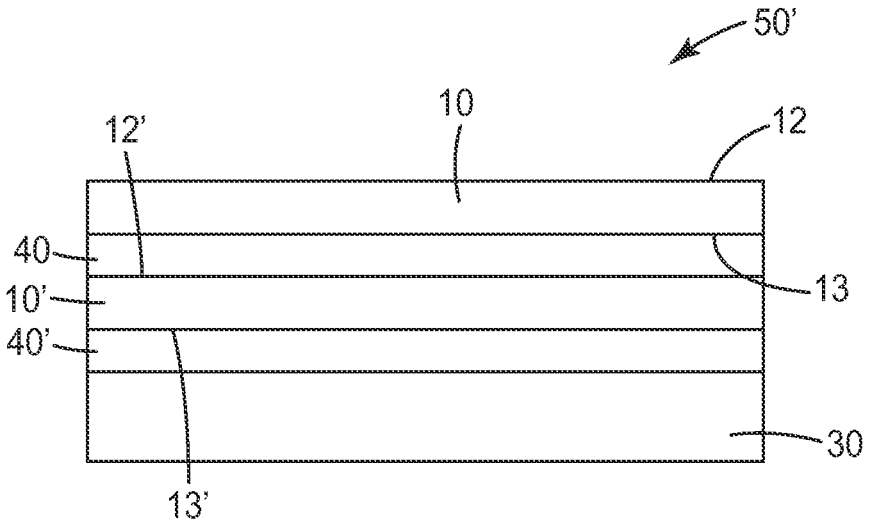
FIG. 10B is a schematic cross sectional diagram of a polishing pad in accordance with some embodiments of the present disclosure.

In some embodiments, the polishing pads of the present disclosure may include at least two polishing layers, i.e. a multi-layered arrangement of polishing layers. The polishing layers of a polishing pad having a multi-layered arrangement of polishing layers may include any of the polishing layer embodiments of the present disclosure. FIG. 10B shows polishing pad 50' having a multi-layered arrangement of polishing layers. Polishing pad 50' includes polishing layer 10, having working surface 12 and second surface 13 opposite working surface 12, and second polishing layer 10', having working surface 12' and second surface 13' opposite working surface 12', disposed between polishing layer 10 and a subpad 30. The two polishing layers may be releasably coupled together, such that, when polishing layer 10 has, for example, reached the end of its useful life or has been damaged, such that is no longer useable, polishing layer 10 can be removed from the polishing pad and expose the working surface 12' of the second polishing layer 10'. Polishing may then continue using the fresh working surface of the second polishing layer. One benefit of a polishing pad having a multi-layered arrangement of polishing layers is that the down time and costs associated with pad changeover is significantly reduce. Optional foam layer 40 may be disposed between polishing layers 10 and 10'. Optional foam layer 40' may be disposed between polishing layer 10' and subpad 30. The optional foam layers of a polishing pad having a multi-layered arrangement of polishing layers may be the same foam or different foam. The one or more optional foam layers may have the same durometer and thickness ranges, as previously described for optional foam layer 40. The number of optional foam layers may be the same as the number of polishing layers within a polishing pad or may be different.

An adhesive layer may be used to couple second surface 13 of polishing layer 10 to the working surface of 12' of second polishing layer 10'. The adhesive layer may include a single layer of adhesive, e.g. a transfer tape adhesive, or multiple layers of adhesive, e.g. a double sided tape that may include a backing. If multiple layers of adhesive are used, the adhesives of the adhesive layers may be the same or different. When an adhesive layer is used to releasably couple polishing layer 10 to second polishing layer 10', the adhesive layer may cleanly release from working surface 12' of polishing layer 10' (adhesive layer remains with second surface 13 of polish layer 10), may cleanly release from second surface 13 of polishing layer 10 (adhesive layer remains with working surface 12' of polishing layer 10') or portions of the adhesive layer may remain on second surface 13 of polishing layer 10 and first surface 12' of second polishing layer 10'. The adhesive layer may be soluble or dispersable in an appropriate solvent, so that the solvent may be used to aid in the removal of any residual adhesive of the adhesive layer that may remain on first surface 12' of second polishing layer 10' or, if the adhesive layer remained with first surface 12', to dissolve or disperse the adhesive of the adhesive layer to expose first surface 12' of second polishing layer 10'.

The adhesive of the adhesive layer may be a pressure sensitive adhesive (PSA). If the pressure sensitive adhesive layer includes at least two adhesive layers, the tack of each adhesive layer may be adjusted to facilitate clean removal of the adhesive layer from either second surface 13 of polishing layer 10 or first surface 12' of second polishing layer 10'. Generally, the adhesive layer having the lower tack with respect to the surface it is adhered to, may cleanly release from that surface. If the pressure sensitive adhesive layer includes a single adhesive layer, the tack of each major surface of the adhesive layer may be adjusted to facilitate clean removal of the adhesive layer from either second surface 13 of polishing layer 10 or first surface 12' of second polishing layer 10'. Generally, the adhesive surface having the lower tack with respect to the surface it is adhered to, may cleanly release from that surface. In some embodiments, the tack of the adhesive layer to working surface 12' of second polishing layer 10' is lower than the tack of the adhesive layer to second surface 13 of polishing layer 10. In some embodiments, the tack of the adhesive layer to working surface 12' of second polishing layer 10' is greater than the tack of the adhesive layer to second surface 13 of polishing layer 10.

By releasably couple it is meant that a polishing layer, e.g. an upper polishing layer, may be removed from a second polishing layer, e.g. a lower polishing layer, without damaging the second polishing layer. An adhesive layer, particularly a pressure sensitive adhesive layer, may be able to releasable couple a polishing layer to a second polishing layer due to the adhesive layers unique peel strength and shear strength. The adhesive layer may be designed to have a low peel strength, such that a surface of a polishing layer can be easily peeled from it, yet have a high shear strength, such that under the shear stress during polishing, the adhesive will remain firmly adhered to the surface. A polishing layer may be removed from a second polishing layer by peeling the first polishing layer away from the second polishing layer.

In any of the above described polishing pads having a multi-layered arrangement of polishing layers, the adhesive layer may be a pressure sensitive adhesive layer. The pressure sensitive adhesive of the adhesive layer may include may include, without limitation, natural rubber, styrene butadiene rubber, styreneisoprene-styrene (co)polymers, styrene-butadiene-styrene (co)polymers, polyacrylates including (meth)acrylic (co)polymers, polyolefins such as polyisobutylene and polyisoprene, polyurethane, polyvinyl ethyl ether, polysiloxanes, silicones, polyurethanes, polyureas, or blends thereof. Suitable solvent soluble or dispersible pressure sensitive adhesives may include, without limitation, those soluble in hexane, heptane, benzene, toluene, diethyl ether, chloroform, acetone, methanol, ethanol, water, or blends thereof. In some embodiments the pressure sensitive adhesive layer is at least one of water soluble or water dispersible.

In any of the above described polishing pads having a multi-layered arrangement of polishing layers, which include an adhesive layer to couple the polishing layers, the adhesive layer may include a backing. Suitable backing layer materials may include, without limitation, paper, polyethylene terephthalate films, polypropylene films, polyolefins, or blends thereof.

In any of the above described polishing pads having a multi-layered arrangement of polishing layers, the working surface or second surface of any given polishing layer may include a release layer, to aid in the removal of a polishing layer from a second polishing layer. The release layer may be in contact with a surface of the polishing layer and an adjacent adhesive layer which is coupling the polishing layer to a second polishing layer. Suitable release layer materials may include, without limitation, silicone, polytetrafluoroethylene, lecithin, or blends thereof.

In any of the above described polishing pads having a multi-layered arrangement of polishing layers having one or more optional foam layers, the foam layer surface adjacent to the second surface of a polishing layer may be permanently coupled to the second surface of the polishing layer. By permanently coupled, it is meant that the foam layer is not designed to be removed from the polishing layer second surface and/or remains with the polishing layer, when the polishing layer is removed from the polishing pad to expose the working surface of an underlying polishing layer. An adhesive layer, as previously described, may be used to releasably couple the surface of the foam layer adjacent to the working surface of an adjacent, underlying polishing layer. In use, a worn polishing layer with permanently coupled foam layer may then be removed from the underlying polishing layer, exposing the fresh working surface of the corresponding underlying polishing layer. In some embodiments, an adhesive may be used to permanently couple the adjacent foam layer surface to the adjacent second surface of a polishing layer and the adhesive may be selected to have the desired peel strength to maintain coupling between the second surface of the polishing layer and adjacent foam layer surface, when the polishing layer is removed from the polishing pad. In some embodiments, the peel strength between a polishing layer second surface and an adjacent foam layer surface is greater than the peel strength between the opposed foam surface and an adjacent working surface of an adjacent underlying polishing layer, e.g. a second polishing layer.

The number of polishing layers in a polish pad having a multi-layered arrangement of polishing layers is not particular limited. In some embodiments the number of polishing layers in a polish pad having a multi-layered arrangement of polishing layers may be between about 2 and about 20, between about 2 and about 15, between about 2 and about 10, between about 2 and about 5, between about 3 and about 20, between about 3 and about 15, between about 3 and about 10, or even between about 3 and about 5

In one embodiment, the present disclosure provides a polishing pad comprising:

a polishing layer having a working surface and a second surface opposite the working surface;

wherein the working surface includes a plurality of precisely shaped pores, a plurality of precisely shaped asperities and a land region;

wherein each pore has a pore opening, each asperity has an asperity base, and a plurality of the asperity bases are substantially coplanar relative to at least one adjacent pore opening;

wherein the depth of the plurality of precisely shaped pores is less than the thickness of the land region adjacent to each precisely shaped pore and the thickness of the land region is less than about 5 mm;

wherein the polishing layer comprises a polymer; and at least one second polishing layer having a working surface and a second surface opposite the working surface; wherein the working surface includes a plurality of precisely shaped pores, a plurality of precisely shaped asperities and a land region;

wherein each pore has a pore opening, each asperity has an asperity base, and a plurality of the asperity bases are substantially coplanar relative to at least one adjacent pore opening;

wherein the depth of the plurality of precisely shaped pores is less than the thickness of the land region adjacent to each precisely shaped pore and the thickness of the land region is less than about 5 mm;

wherein the second polishing layer comprises a polymer; and wherein the second surface of the polishing layer is adjacent to the working surface of the second polishing layer. The polishing pad may further include an adhesive layer disposed between the second surface of the polishing layer and the working surface of the second polishing layer. In some embodiments, the adhesive layer may be in contact with at least one of the second surface of the polishing layer and the working surface of the second polishing layer. In some embodiments, the adhesive layer may be in contact with both the second surface of the polishing layer and the working surface of the second polishing layer. The adhesive layer may be a pressure sensitive adhesive layer.

Figure 11:
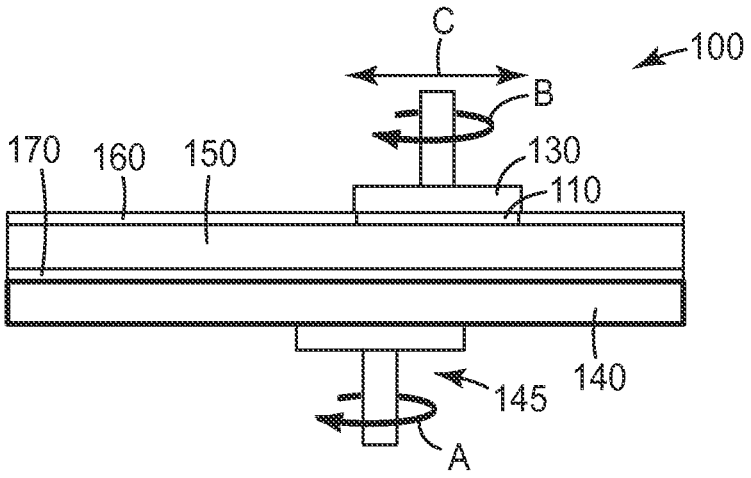
FIG. 11 illustrates a schematic diagram of an example of a polishing system for utilizing the polishing pads and methods in accordance with some embodiments of the present disclosure.

FIG. 11 schematically illustrates an example of a polishing system 100 for utilizing polishing pads and methods in accordance with some embodiments of the present disclosure. As shown, the system 100 may include a polishing pad 150 and a polishing solution 160. The system may further include one or more of the following: a substrate 110 to be polished or abraded, a platen 140 and a carrier assembly 130. An adhesive layer 170 may be used to attach the polishing pad 150 to platen 140 and may be part of the polishing system. Polishing solution 160 may be a layer of solution disposed about a major surface of the polishing pad 150. Polishing pad 150 may be any of the polishing pad embodiments of the present disclosure and includes at least one polishing layer (not shown), as described herein, and may optionally include a subpad and/or foam layer(s), as described for polishing pads 50 and 50' of FIGS. 10A and 10B, respectively. The polishing solution is typically disposed on the working surface of the polishing layer of the polishing pad. The polishing solution may also be at the interface between substrate 110 and polishing pad 150. During operation of the polishing system 100, a drive assembly 145 may rotate (arrow A) the platen 140 to move the polishing pad 150 to carry out a polishing operation. The polishing pad 150 and the polishing solution 160 may separately, or in combination, define a polishing environment that mechanically and/or chemically removes material from or polishes a major surface of a substrate 110. To polish the major surface of the substrate 110 with the polishing system 100, the carrier assembly 130 may urge substrate 110 against a polishing surface of the polishing pad 150 in the presence of the polishing solution 160. The platen 140 (and thus the polishing pad 150) and/or the carrier assembly 130 then move relative to one another to translate the substrate 110 across the polishing surface of the polishing pad 150. The carrier assembly 130 may rotate (arrow B) and optionally transverse laterally (arrow C). As a result, the polishing layer of polishing pad 150 removes material from the surface of the substrate 110. In some embodiments, inorganic abrasive material, e.g. inorganic abrasive particles, may be included in the polishing layer to facilitate material removal from the surface of the substrate. In other embodiments, the polishing layer is substantially free of any inorganic abrasive material and the polishing solution may be substantially free of organic or inorganic abrasive particle or may contain organic or inorganic abrasive particles or combination thereof. It is to be appreciated that the polishing system 100 of FIG. 11 is only one example of a polishing system that may be employed in connection with the polishing pads and methods of the present disclosure, and that other conventional polishing systems may be employed without deviating from the scope of the present disclosure.

In another embodiment, the present disclosure relates to a method of polishing a substrate, the method of polishing including: providing a polishing pad according to any one of the previous polishing pads, wherein the polishing pad may include any of the previously described polishing layers; providing a substrate, contacting the working surface of the polishing pad with the substrate surface, moving the polishing pad and the substrate relative to one another while maintaining contact between the working surface of the polishing pad and the substrate surface, wherein polishing is conducted in the presence of a polishing solution. In some embodiments, the polishing solution is a slurry and may include any of the previously discussed slurries. In another embodiment the present disclosure relates to any of the preceding methods of polishing a substrate, wherein the substrate is a semiconductor wafer. The materials comprising the semiconductor wafer surface to be polished, i.e. in contact with the working surface of the polishing pad, may include, but are not limited to, at least one of a dielectric material, an electrically conductive material, a barrier/adhesion material and a cap material. The dielectric material may include at least one of an inorganic dielectric material, e.g. silicone oxide and other glasses, and an organic dielectric material. The metal material may include, but is not limited to, at least one of copper, tungsten, aluminum, silver and the like. The cap material may include, but is not limited to, at least one of silicon carbide and silicon nitride. The barrier/adhesion material may include, but is not limited to, at least one of tantalum and tantalum nitride. The method of polishing may also include a pad conditioning or cleaning step, which may be conducted in-situ, i.e. during polishing. Pad conditioning may use any pad conditioner or brush known in the art, e.g. 3M CMP PAD CONDITIONER BRUSH PB33A, 4.25 in diameter available from the 3M Company, St. Paul, Minn. Cleaning may employ a brush, e.g. 3M CMP PAD CONDITIONER BRUSH PB33A, 4.25 in diameter available from the 3M Company, and/or a water or solvent rinse of the polishing pad.

In another embodiment, the present disclosure provides a method of simultaneously forming a plurality of precisely shaped asperities and a plurality of precisely shaped pores in a polishing layer of a polishing pad, the method includes: providing a negative master tool having negative topographical features corresponding to the plurality of precisely shaped asperities and negative topographical features corresponding to the plurality of precisely shaped pores; providing a molten polymer or a curable polymer precursor; coating the molten polymer or curable polymer precursor onto the negative master tool, urging the molten polymer or curable polymer precursor against the negative tooling such that the topographical features of the negative master tool are imparted into the surface of the molten polymer or curable polymer precursor; cooling the molten polymer or curing the curable polymer precursor until it solidifies forming a solidified polymer layer; removing the solidified polymer layer from the negative master tool, thereby simultaneously forming a plurality of precisely shaped asperities and a plurality of precisely shaped pores in a polishing layer of a polishing pad. The polishing pad may include any one of the polishing pad embodiments disclosed herein. In some embodiments, the method of simultaneously forming a plurality of precisely shaped asperities and a plurality of precisely shaped pores in a polishing layer of a polishing pad includes wherein each pore has a pore opening, each asperity has an asperity base, and a plurality of the asperity bases are substantially coplanar relative to at least one adjacent pore opening. The dimensions, tolerances, shapes and patterns of the negative topographical features required in the negative master tool correspond, respectively, to the dimensions, tolerances, shapes and patterns of the plurality of precisely shaped asperities and the plurality of precisely shaped pores described herein. The dimensions and tolerances of the polishing layer embodiments formed by this method correspond to those of the polishing layer embodiments previously describe described herein. The dimensions of the negative master tool may need to be modified for shrinkage due to thermal expansion of the molten polymer relative to the solidified polymer or for shrinkage associated with the curing of a curable polymer precursor.

In another embodiment, the present disclosure provides a method for simultaneously forming a plurality of precisely shaped asperities, a plurality of precisely shaped pores and at least one macro-channel in a polishing layer of a polishing pad, the method includes: providing a negative master tool having negative topographical features corresponding to the plurality of precisely shaped asperities, negative topographical features corresponding to the plurality of precisely shaped pores and negative topographical features corresponding to the at least one macro-channel; providing a molten polymer or a curable polymer precursor; coating the molten polymer or curable polymer precursor onto the negative master tool, urging the molten polymer or curable polymer precursor against the negative tooling such that the topographical features of the negative master tool are imparted into the surface of the molten polymer or curable polymer precursor; cooling the molten polymer or curing the curable polymer precursor until it solidifies forming a solidified polymer layer; removing the solidified polymer layer from the negative master tool, thereby simultaneously forming a plurality of precisely shaped asperities, a plurality of precisely shaped pores and at least one macro-channel in a polishing layer of a polishing pad. The polishing pad may include any one of the polishing pad embodiments disclosed herein. In some embodiments, the method for simultaneously forming a plurality of precisely shaped asperities, a plurality of precisely shaped pores and at least one macro-channel in a polishing layer of a polishing pad includes wherein each pore has a pore opening, each asperity has an asperity base, and a plurality of the asperity bases are substantially coplanar relative to at least one adjacent pore opening. The dimensions, tolerances, shapes and patterns of the negative topographical features required in the negative master tool correspond, respectively, to the dimensions, tolerances, shapes and patterns of the plurality of precisely shaped asperities, the plurality of precisely shaped pores and the at least one macro-channel previously described herein. The dimensions and tolerances of the polishing layer embodiments formed by this method correspond to those of polishing layer embodiments described herein. The dimensions of the negative master tool may need to be modified for shrinkage due to thermal expansion of the molten polymer relative to the solidified polymer or for shrinkage associated with the curing of a curable polymer precursor.

Select embodiments of the present disclosure include, but are not limited to, the following:

In a first embodiment, the present disclosure provides a polishing pad comprising a polishing layer having a working surface and a second surface opposite the working surface;

wherein the working surface includes a plurality of precisely shaped pores, a plurality of precisely shaped asperities and a land region;

wherein each pore has a pore opening, each asperity has an asperity base, and a plurality of the asperity bases are substantially coplanar relative to at least one adjacent pore opening;

wherein the depth of the plurality of precisely shaped pores is less than the thickness of the land region adjacent to each precisely shaped pore and the thickness of the land region is less than about 5 mm; and wherein the polishing layer comprises a polymer.

In a second embodiment, the present disclosure provides a polishing pad according to the first embodiment, wherein the height of at least about 10% of the plurality of precisely shaped asperities is between about 1 micron and about 200 microns.

In a third embodiment, the present disclosure provides a polishing pad according to the first or second embodiments, wherein the depth of at least about 10% of the plurality of precisely shaped pores is between about 1 micron and about 200 microns.

In a fourth embodiment, the present disclosure provides a polishing pad according to any one of the first through third embodiments, wherein the areal density of the plurality of precisely shaped asperities is independent of the areal density of the plurality precisely shaped pores.

In a fifth embodiment, the present disclosure provides a polishing pad according to any one of the first through fourth embodiments, wherein the polishing layer further comprises a polymer, wherein the polymer includes thermoplastics, thermoplastic elastomers (TPEs), thermosets and combinations thereof.

In a sixth embodiment, the present disclosure provides a polishing pad according to the any one of the first through fifth embodiments, wherein the polymer includes a thermoplastic or thermoplastic elastomer.

In a seventh embodiment, the present disclosure provides a polishing pad according to the sixth embodiment, wherein the thermoplastic and thermoplastic elastomer include polyurethanes, polyalkylenes, polybutadiene, polyisoprene, polyalkylene oxides, polyesters, polyamides, polycarbonates, polystyrenes, block copolymers of any of the proceeding polymers, and combinations thereof.

In an eighth embodiment, the present disclosure provides a polishing pad according to any one of the first through seventh embodiments, wherein the polishing layer is free of through-holes.

In a ninth embodiment, the present disclosure provides a polishing pad according to any one of the first through eighth embodiments, wherein the polishing layer is a unitary sheet.

In a tenth embodiment, the present disclosure provides a polishing pad according to any one of the first through ninth embodiments, wherein the polishing layer contains less than 1% by volume inorganic abrasive particles.

In an eleventh embodiment, the present disclosure provides a polishing pad according to any one of the first through tenth embodiments, wherein the precisely shaped asperities are solid structures.

In a twelfth embodiment, the present disclosure provides a polishing pad according to any one of the first through eleventh embodiments, wherein the precisely shaped asperities are free of machined holes.

In a thirteenth embodiment, the present disclosure provides a polishing pad according to any one of the first through twelfth embodiments, wherein the polishing layer is flexible and capable of being bent back upon itself producing a radius of curvature in the bend region of between about 10 cm and about 0.1 mm.

In a fourteenth embodiment, the present disclosure provides a polishing pad according to any one of the first through thirteenth embodiments, wherein the ratio of the surface area of the distal ends of the precisely shaped asperities to the projected polishing pad surface area is between about 0.0001 and about 4.

In a fifteenth embodiment, the present disclosure provides a polishing pad according to any one of the first through fourteenth embodiments, wherein the ratio of the surface area of the distal ends of the precisely shaped asperities to the surface area of the precisely shaped pore openings is between about 0.0001 and about 4.

In a sixteenth embodiment, the present disclosure provides a polishing pad according to the fifteenth embodiment, further comprising at least one macro-channel.

In a seventeenth embodiment, the present disclosure provides a polishing pad according to the sixteenth embodiment, wherein the depth of at least a portion of the plurality of precisely shaped pores is less than the depth of at least a portion of the at least one macro-channel.

In an eighteenth embodiment, the present disclosure provides a polishing pad according to any one of the sixteenth and seventeenth embodiments, wherein the width of at least a portion of the plurality of precisely shaped pores is less than the width of at least a portion of the at least one macro-channel.

In a nineteenth embodiment, the present disclosure provides a polishing pad according to any one of the sixteenth through eighteenth embodiments, wherein the ratio of the depth of at least a portion of the at least one macro-channel to the depth of a portion of the precisely shaped pores is between about 1.5 and about 1000.

In a twentieth embodiment, the present disclosure provides a polishing pad according to any one of the sixteenth through nineteenth embodiments, wherein the ratio of the width of at least a portion of the at least one macro-channel to the width of a portion of the precisely shaped pores is between about 1.5 and about 1000.

In a twenty-first embodiment, the present disclosure provides a polishing pad according to any one of the first through twentieth embodiments, wherein at least a portion of the precisely shaped asperities include a flange.

In a twenty-second embodiment, the present disclosure provides a polishing pad according to any one of the first through twenty-first embodiments, wherein the polishing layer includes a plurality of nanometer-size topographical features on at least one of the surface of the precisely shaped asperities, the surface of the precisely shaped pores and the surface of the land region.

In a twenty-third embodiment, the present disclosure provides a polishing pad according to the twenty-second embodiment, wherein the plurality of nanometer sized features include regular or irregularly shaped grooves, wherein the width of the grooves is less than about 250 nm.

In a twenty-fourth embodiment, the present disclosure provides a polishing pad according to any one of the first through twenty-third embodiments, wherein the working surface comprises a secondary surface layer and a bulk layer and wherein the chemical composition in at least a portion of the secondary surface layer differs from the chemical composition within the bulk layer.

In a twenty-fifth embodiment, the present disclosure provides a polishing pad according to the twenty-fourth embodiment, wherein the chemical composition in at least a portion of the secondary surface layer, which differs from the chemical composition within the bulk layer, includes silicon.

In a twenty-sixth embodiment, the present disclosure provides a polishing pad according to any one of the first through twenty-fifth embodiments, wherein at least one of the receding contact angle and advancing contact angle of the secondary surface layer is less than the corresponding receding contact angle and advancing contact angle of the bulk layer.

In a twenty-seventh embodiment, the present disclosure provides a polishing pad according to the twenty-sixth embodiment, wherein at least one of the receding contact angle and advancing contact angle of the secondary surface layer is at least about 20° less than the corresponding receding contact angle or advancing contact angle of the bulk layer.

In a twenty-eighth embodiment, the present disclosure provides a polishing pad according to any one of the first through twenty-seventh embodiments, wherein the receding contact angle of the working surface is less than about 50°.

In a twenty-ninth embodiment, the present disclosure provides a polishing pad according to any one of the first through twenty-eighth embodiments, wherein the receding contact angle of the working surface is less than about 30°.

In a thirtieth embodiment, the present disclosure provides a a polishing pad according to the first through twenty-ninth embodiment, wherein the polishing layer is substantially free of inorganic abrasive particles.

In a thirty-first embodiment, the present disclosure provides a polishing pad according to any one of the first through thirtieth embodiments, wherein the polishing layer further comprises a plurality of independent or inter-connected macro-channels.

In a thirty-second embodiment, the present disclosure provides a polishing pad according to the first through thirty-first embodiments, further comprising a subpad, wherein the subpad is adjacent to the second surface of the polishing layer.

In a thirty-third embodiment, the present disclosure provides a polishing pad according to the thirty-second embodiment, further comprising a foam layer, wherein the foam layer is interposed between the second surface of the polishing layer and the subpad.

In a thirty-fourth embodiment, the present disclosure the present disclosure provides a polishing pad according to any one of the first through thirty-third embodiments, wherein at least one of the plurality of precisely shaped asperities and the precisely shaped pores are arranged in a repeating pattern.

In a thirty-fifth embodiment, the present disclosure provides a polishing system comprising the polishing pad of anyone of the first through thirty-fourth embodiments and a polishing solution.

In a thirty-sixth embodiment, the present disclosure provides a polishing system according to the thirty-fifth embodiment, wherein the polishing solution is a slurry.

In a thirty-seventh embodiment, the present disclosure provides a polishing system according to the thirty-fifth and thirty-sixth embodiments, wherein the polishing layer contains less than 1% by volume inorganic abrasive particles.

In a thirty-eighth embodiment, the present disclosure provides a method of polishing a substrate, the method comprising:

providing a polishing pad according to claim 1;

providing a substrate;

contacting the working surface of the polishing pad with the substrate surface;

moving the polishing pad and the substrate relative to one another while maintaining contact between the working surface of the polishing pad and the substrate surface;

and wherein polishing is conducted in the presence of a polishing solution.

In a thirty-ninth embodiment, the present disclosure provides a method of polishing a substrate according to the thirty-eighth embodiment, wherein the substrate is a semiconductor wafer.

In a fortieth embodiment, the present disclosure provides method of polishing a substrate according to the thirty-ninth embodiment, wherein the semiconductor wafer surface in contact with the working surface of the polishing pad includes at least one of a dielectric material and an electrically conductive material.

In a forty-first embodiment, the present disclosure provides a method for simultaneously forming a plurality of precisely shaped asperities and a plurality of precisely shaped pores in a polishing layer of a polishing pad, the method includes: providing a negative master tool having negative topographical features corresponding to the plurality of precisely shaped asperities and negative topographical features corresponding to the plurality of precisely shaped pores; providing a molten polymer or a curable polymer precursor; coating the molten polymer or curable polymer precursor onto the negative master tool, urging the molten polymer or curable polymer precursor against the negative tooling such that the topographical features of the negative master tool are imparted into the surface of the molten polymer or curable polymer precursor; cooling the molten polymer or curing the curable polymer precursor until it solidifies forming a solidified polymer layer; removing the solidified polymer layer from the negative master tool, thereby simultaneously forming a plurality of precisely shaped asperities and a plurality of precisely shaped pores in a polishing layer of a polishing pad.

In a forty-second embodiment, the present disclosure provides a method of simultaneously forming a plurality of precisely shaped asperities and a plurality of precisely shaped pores in a polishing layer of a polishing pad according to the forty-first embodiment, wherein each pore has a pore opening, each asperity has an asperity base, and a plurality of the asperity bases are substantially coplanar relative to at least one adjacent pore opening.

In a forty-third embodiment, the present disclosure provides a method of simultaneously forming a plurality of precisely shaped asperities, a plurality of precisely shaped pores and at least one macro-channel in a polishing layer of a polishing pad, the method includes: providing a negative master tool having negative topographical features corresponding to the plurality of precisely shaped asperities, negative topographical features corresponding to the plurality of precisely shaped pores and negative features corresponding to the at least one macro-channel; providing a molten polymer or a curable polymer precursor; coating the molten polymer or curable polymer precursor onto the negative master tool, urging the molten polymer or curable polymer precursor against the negative tooling such that the topographical features of the negative master tool are imparted into the surface of the molten polymer or curable polymer precursor; cooling the molten polymer or curing the curable polymer precursor until it solidifies forming a solidified polymer layer; removing the solidified polymer layer from the negative master tool, thereby simultaneously forming a plurality of precisely shaped asperities, a plurality of precisely shaped pores and at least one macro-channel in a polishing layer of a polishing pad.

In a forty-forth embodiment, the present disclosure provides a method for simultaneously forming a plurality of precisely shaped asperities, a plurality of precisely shaped pores and at least one macro-channel in a polishing layer of a polishing pad according to the forty-third embodiment, wherein each pore has a pore opening, each asperity has an asperity base, and a plurality of the asperity bases are substantially coplanar relative to at least one adjacent pore opening.

In a forty-fifth embodiment, the present disclosure provides a polishing pad according to any one of the first through thirty-fourth embodiments, further comprising at least one second polishing layer having a working surface and a second surface opposite the working surface; wherein the working surface includes a plurality of precisely shaped pores, a plurality of precisely shaped asperities and a land region;

wherein each pore has a pore opening, each asperity has an asperity base, and a plurality of the asperity bases are substantially coplanar relative to at least one adjacent pore opening;

wherein the depth of the plurality of precisely shaped pores is less than the thickness of the land region adjacent to each precisely shaped pore and the thickness of the land region is less than about 5 mm;

wherein the at least one second polishing layer comprises a polymer; and wherein the second surface of the polishing layer is adjacent to the working surface of the at least one second polishing layer.

In a forty-sixth embodiment, the present disclosure provides a polishing pad according to the forty-fifth embodiment, further comprising an adhesive layer disposed between the second surface of the polishing layer and the working surface of the at least one second polishing layer.

In a forty-seventh embodiment, the present disclosure provides a polishing pad according to the forty-sixth embodiment, wherein the adhesive layer is a pressure sensitive adhesive layer.

In a forty-eighth embodiment, the present disclosure provides a polishing pad according to the forty-fifth through forty-seventh embodiments, further comprising a foam layer disposed between the second surface of the polishing layer and the working surface of the at least one second polishing layer and a second foam layer adjacent the second surface of the at least one second polishing layer.

EXAMPLES

Test Methods and Preparation Procedures

Thermal Oxide Wafer (200 mm Diameter) Removal Rate Test Method

Substrate removal rates for the following Examples were calculated by determining the change in thickness of the layer being polished from the initial (i.e. before polishing) thickness and the final (Le, after polishing) thickness and dividing this difference by the polishing time. Thickness measurements are made using a non-contacting, film analysis system model 9000B available from Nanometrics, Inc., Milpitas, Calif., Twenty-five points diameter scans with 10 mm edge exclusion were employed.

Copper and Tungsten Wafer (200 mm Diameter) Removal Rate Test Method

Removal rate was calculated by determining the change in thickness of the layer being polished, from the initial thickness and the final thickness, and dividing this difference by the polishing time. For eight inch diameter wafers, thickness measurements were taken with a ResMap 168, fitted with a four point probe, available from Creative Design Engineering, Inc., Cupertino, Calif. Eighty-one point diameter scans with 5 mm edge exclusion were employed.

Copper Wafer (300 mm Diameter) Removal Rate Test Method

Removal rate was calculated by determining the change in thickness of the copper layer being polished. This change in thickness was divided by the wafer polishing time to obtain the removal rate for the copper layer being polished. Thickness measurements for 300 mm diameter wafers were taken with a ResMap 463-FOUP fitted with a four point probe, available from Creative Design Engineering, Inc., Cupertino, Calif., Eighty-one point diameter scans with 5 mm edge exclusion were employed.

Wafer Non-Uniformity Determination

Percent wafer non-uniformity was determined by calculating the standard deviation of the change in thickness of the layer being polished at points on the surface of the wafer (as obtained from any of the above Removal Rate Test Methods), dividing the standard deviation by the average of the changes in thickness of the layer being polished, and multiplying the value obtained by 100 results were therefore reported as a percentage.

Advancing and Receding Contact Angle Measurement Test Method

The advancing and receding angles of the samples were measured using a Drop Shape Analyzer Model DSA 100, available from Kruss USA, Matthews, N.C. The samples were adhered to the stage of the testing apparatus using double sided tape. A total volume of 2.0 μl of DI water was pumped carefully to the center of the unit cell of the micro-replicated surface, to avoid flowing into the surrounding grooves, at a rate of 100/minute. At the same time, images of the drop were captured with the help of a camera and transferred to the Drop Shape Analysis software for advancing contact angle analysis. Then, 1.0 μl water was removed from the water drop at a rate of 10 μl/minute to ensure the shrinkage of the baseline of the water drop. Similar to the advancing angle measurement, images of the drop were captured at the same time and analyzed for receding angle by the Drop Shape Analysis software.

Optical Microscopy Test Method

Pad characteristics were measured using a 3D optical microscope, Model ContourGT-X, available from Bruker Corp. 2700 North Crescent Ridge Drive, The Woodlands, Tex. During the measurement, the samples were placed on the sample stage beneath a 50× objective lens. A 0.7 mm×0.6 mm image was stitched together from 24 individual measurements using the included Bruker software. The critical dimensional analysis tool in the Bruker software was then used to individually measure the diameter of the top of the asperities and the diameter of the pores. The centers of the resulting circles from the diameter measurements were used to find the distance between adjacent asperities and pores, i.e. the pitch. The pore depth and asperity height were measured from the land area using the region analysis routine from the Bruker software. This routine split the scan into three levels by height (asperity, land area, pore) and then took an average height for each pore and asperity using the land area as the reference plane. The bearing area was measured using the same scan but analyzed with MountainsMap Universal software from Digital Surf, 16 rue Lavoisier, F-25000 Besancon, France. A square area covering one or more asperities was viewed for the coverage of the top of the asperities using the "Slices" study in MountainsMap. The height of the slice was kept constant and then the analysis repeated across the full scan.

200 mm Cu Wafer Polishing Method

Wafers were polished using a CMP polisher available under the trade designation REFLEXION (REFX464) polisher from Applied Materials, Inc, of Santa Clara, Calif., The polisher was fitted with a 200 mm PROFILER head for holding 200 mm diameter wafers. A 30.5 inch (77.5 cm) diameter pad was laminated to the platen of the polishing tool via a psa. There was no pad break-in procedure. During polishing, the pressures applied to the PROFILER head's upper chamber, inner chamber, external chamber and retaining ring, were 0.8 psi (5.5 kPa), 1.4 psi (9.7 kPa), 1.4 psi (9.7 kPa) and 3.1 psi (21.4 kPa), respectively. The platen speed was 120 rpm and the head speed was 116 rpm. A brush type pad conditioner, available under the trade designation 3M CMP PAD CONDITIONER BRUSH PB33A, 4.25 in diameter available from the 3M Company, St. Paul, Minn. was mounted on the conditioning arm and used at a speed of 108 rpm with a 5 lbf downforce. The pad conditioner was swept across the surface of the pad via a sinusoidal sweep, with 100% in-situ conditioning. The polishing solution was a slurry, available under the trade designation ESL 1076 from Fujimi Corporation, Kiyosu, Aichi, Japan. Prior to use, the PL 1076 slurry was diluted with DI water and 30% hydrogen peroxide was added such that the final volume ratios of PL1076/DI water/30% $H_2O_2$ were 10/87/3. Polishing was conducted at a solution flow rate of 300 mL/min. At the times indicated in Table 1, Cu monitor wafers were polished for 1 minute and subsequently measured. 200 mm diameter Cu monitor wafers were obtained from Advantiv Technologies Inc., Freemont, Calif. The wafer stack was as follows: 200 mm reclaimed Si substrate+PE-TEOS 5KA+Ta 250A+PVD Cu 1KA+e-Cu 20KA+anneal. Thermal oxide wafers were used as "dummy" wafers, between monitor wafer polishing and were polished for 1 minute each.

300 mm Cu Wafer Polishing Method

Wafers were polished using a CMP polisher available under the trade designation REFLEXION polisher from Applied Materials, Inc. of Santa Clara, Calif. The polisher was fitted with a 300 mm CONTOUR head for holding 300 mm diameter wafers. A 30.5 inch (77.5 cm) diameter pad was laminated to the platen of the polishing tool with a layer of PSA. There was no break-in procedure. During this polish, the pressures applied to the CONTOUR head's zones, zone 1, zone 2, zone 3, zone 4, zone 5 and retaining ring were 3.3 psi (22.8 kPa), LG psi (11.0 kPa), 1.4 psi (9.7 kPa), 1.3 psi (9.0 kPa), 1.3 psi (9.0 kPa) and 3.8 psi (26.2 kPa), respectively. The platen speed was 53 rpm and the head speed was 47 rpm. A brush type pad conditioner, available under the trade designation 3M CMP PAD CONDITIONER BRUSH PB33A, 4.25 in diameter available from the 3M Company, St. Paul, Minn. was mounted on the conditioning arm and used at a speed of 81 rpm with a 5 lbf downforce. The pad conditioner was swept across the surface of the pad via a sinusoidal sweep, with 100% in-situ conditioning. The polishing solution was a slurry, available under the trade designation PL 1076 from Fujimi Corporation, Kiyosu, Aichi, Japan. Prior to use, the Pt. 1076 slurry was diluted with DI water and 30% hydrogen peroxide was added such that the final volume ratios of PL1076/DI water/30% $H_2O_2$ were 10/87/3. Polishing was conducted at a solution flow rate of 300 mL/min. At the times indicated in Table 2, Cu monitor wafers were polished for 1 minute and subsequently measured. 300 mm diameter Cu monitor wafers were obtained from Advantiv Technologies Inc., Freemont, Calif. The wafer stack was as follows: 300 mm prime Si substrate+thermal oxide 3KA+TaN 250A+PVD Cu 1KA+e-Cu 15KA+anneal. Thermal oxide wafers were used as "dummy" wafers, between monitor wafer polishing and were polished for 1 minute each.

200 mm Tungsten Wafer Polishing Method

The tungsten wafer polishing method was the same as that described for 200 mm copper wafer polishing except the 200 mm copper monitor wafers were replaced by 200 mm tungsten monitor wafers and the polishing solution was a slurry, available under the trade designation SEMI-SPERSE W2000 from Cabot Microelectronics, Aurora, Ill. Prior to use, the W2000 slurry was diluted with DI water and 30% hydrogen peroxide was added such that the final volume ratios of W2000/DI water/30% $H_2O_2$ were 46.15/46.15/7.7. Polishing was conducted at a solution flow rate of 300 ml/min. At the times indicated in Table 3, tungsten monitor wafers were polished fort minute and subsequently measured. 200 mm diameter tungsten monitor wafers were obtained from Advantiv Technologies, Inc., Freemont, Calif. The wafer stack was as follows: 200 mm reclaimed Si substrate+PE-TEOS 4KA+PVD Ti 150A+CVD TiN 100A+

CVD W 8KA. Thermal oxide wafers were used as "dummy" wafers, between monitor wafer polishing and were polished for 1 minute each.

200 mm Thermal Oxide Wafer Polishing Method 1

The thermal oxide wafer polishing method was the same as that described for 200 mm copper wafer polishing except the 200 mm copper monitor wafers were replaced by 200 mm thermal oxide monitor wafers and the polishing solution was a ceria slurry, available under the trade designation CES-333 from Ashai Glass Co., LTD., Chiyoda-ku, Tokyo, Japan. Prior to use, the CES-333 slurry was diluted with DI water such that the final volume ratio of CES-333; DI water was 75/25. Polishing was conducted at a solution flow rate of 300 ml/min. At the times indicated in Table 4, thermal oxide monitor wafers were polished for 1. minute and subsequently measured. 200 mm diameter thermal oxide monitor wafers were obtained from Process Specialties Inc., Tracy, Calif. The wafer stack was as follows: reclaimed Si substrate+20KA thermal oxide. Thermal oxide wafers were used as "dummy" wafers, between monitor wafer polishing and were polished for 1 minute each.

200 mm Thermal Oxide Wafer Polishing Method 2

The thermal oxide wafer polishing method was the same as that described for 200 mm Thermal Oxide Polishing Method 1 except the polishing solution was a slurry designed for copper barrier layer polishing, available under the trade designation I-CUE-7002 from Cabot Microelectronics. Prior to use, the I-CUE-7002 slurry was diluted with 30% Hydrogen peroxide such that the final volume ratio of I-CUE-7002/30% $H_2O_2$ was 97.5/2.5. Polishing was conducted at a solution flow rate of 300 ml/rain. Additionally, the head speed was changed from 116 to 113 rpm and the flow rate was either 150 ml/min or 300 ml/min, per Table 5. At the times indicated in Table 5, thermal oxide monitor wafers were polished for 1 minute and measured. 200 mm diameter thermal oxide monitor wafers were obtained from Process Specialties Inc., Tracy, Calif. The wafer stack was as follows: reclaimed Si substrate+20KA thermal oxide. Thermal oxide wafers were used as "dummy" wafers, between monitor wafer polishing and were polished for 1 minute each.

Example 1

A polishing pad having a polishing layer according to FIGS. 6, 7 and 9 was prepared as follows. A sheet of polycarbonate was laser ablated according to the procedures described in U.S. Pat. No. 6,285,001, forming a positive master tool, i.e. a tool having about the same surface topography as that required for polishing layer 10. See FIGS. 6, 7 and 9 and their corresponding descriptions with respect to the desired specific size and distribution of precisely shaped pores, asperities and macro-channels required for the positive master tool. The polycarbonate master tool was then plated with nickel, three iterations, using conventional techniques, forming a nickel negative. Several nickel negatives, 14 inches wide, were formed in this manner and micro-welded together to make a larger nickel negative in order to form an embossing roll, 14 inches wide. The roll was then used in an embossing process, similar to that described in U.S. Patent Application Publication No. 2010/0188751, to form a polishing layer, which was a thin film and which was wound into a roll. The polymeric material used in the embossing process to form the polishing layer was a thermoplastic polyurethane, available under the trade designation ESTANE 58414, available from Lubrizol Corporation, Wickliffe, Ohio. The polyurethane had a durometer of about 65 Shore D and the polishing layer had thickness of about 17 mils (0.432 mm).

Using the Advancing and Receding Contact Angle Measurement Test Method described above, the receding and advancing contact angles of the polishing layer were measured. The advancing contact angle was 144° and the receding contact angle was 54°.

Nanometer-size topographical features were then formed on the working surface of the polishing layer using a plasma process as disclosed in U.S. Provisional Appl. No. 61/858,670 (David, et. al.). A roll of the polishing layer was mounted within the chamber. The polishing layer was wrapped around the drum electrode and secured to the take up roll on the opposite side of the drum. The unwind and take-up tensions were maintained at 4 pounds (13.3 N) and 10 pounds (33.25 N). The chamber door was closed and the chamber pumped down to a base pressure of $5\times10^{-4}$ torr. The first gaseous species was tetramethylsilane gas provided at a flow rate of 20 sccm and the second gaseous species was oxygen provided at a flow rate of 500 sccm. The pressure during the exposure was around 6 mTorr and plasma was turned on at a power of 6000 watts while the tape was advanced at a speed of 2 ft/min (0.6 m/min). The working surface of the polishing layer was exposed to the oxygen/tetramethlysilane plasma for about 120 seconds.

Following the plasma treatment, the Advancing and Receding Contact Angle Measurement Test Method was used to measure the receding and advancing contact angles of the treated polishing layer. The advancing contact angle was 115° and the receding contact angle was 0°.

Figure 12A:
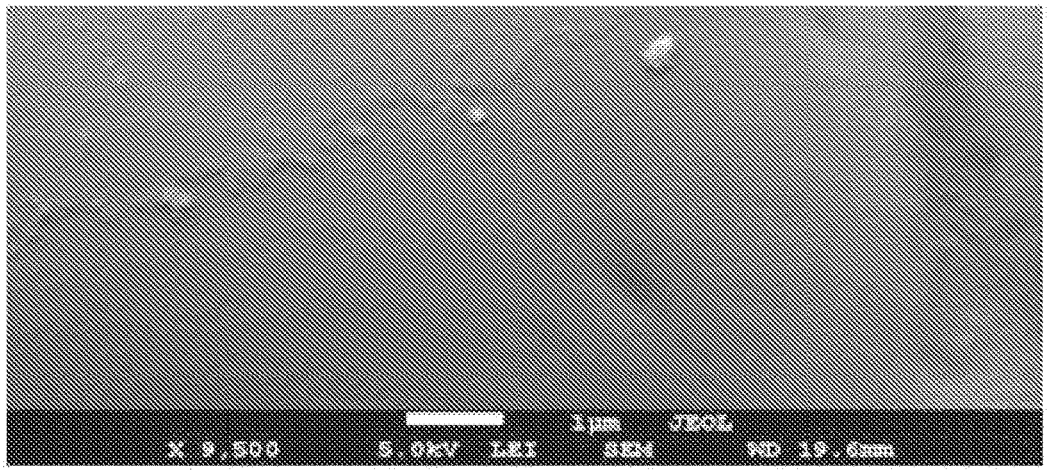
FIGS. 12A and 12B are SEM images of a portion of a polishing layer before and after plasma treatment, respectively.
Figure 12B:
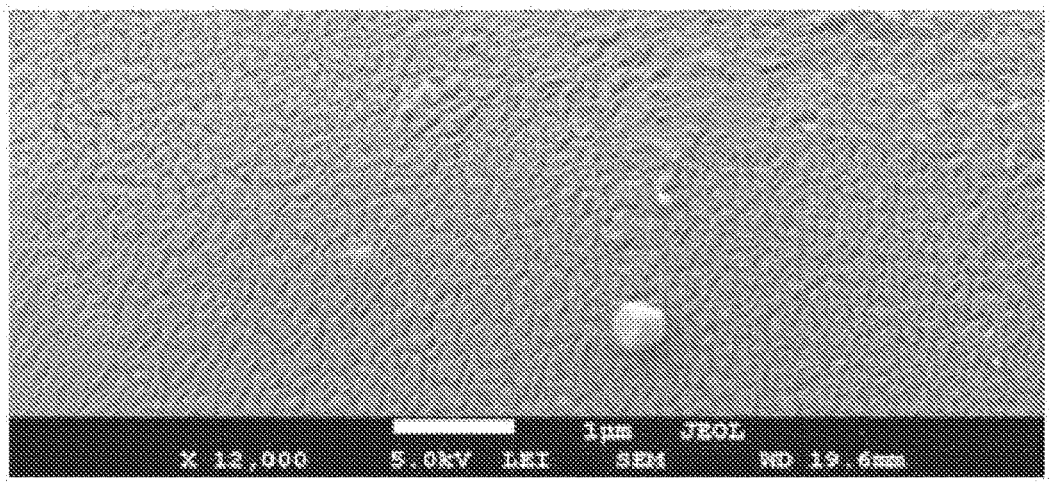
Figure 12C:
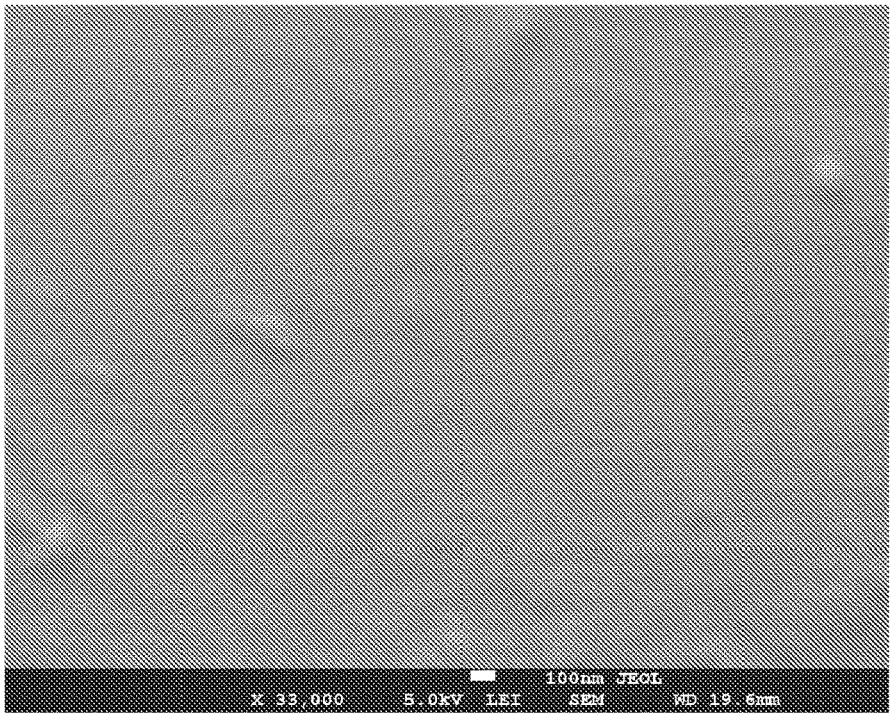
FIGS. 12C and 12D are the SEM images of FIGS. 12A and 12B, respectively, at higher magnification.
Figure 12D:
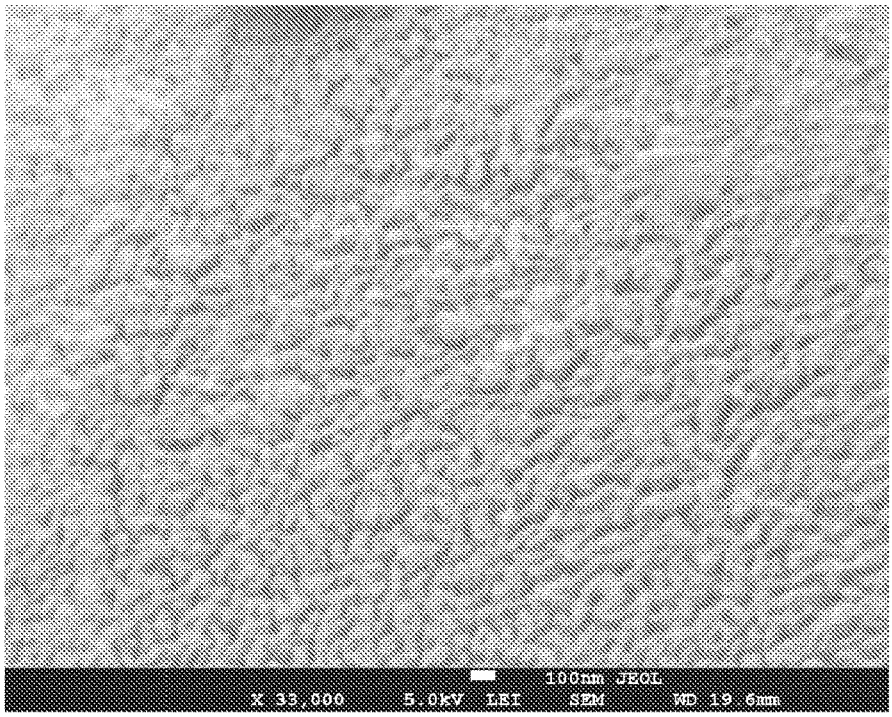
Figure 13A:
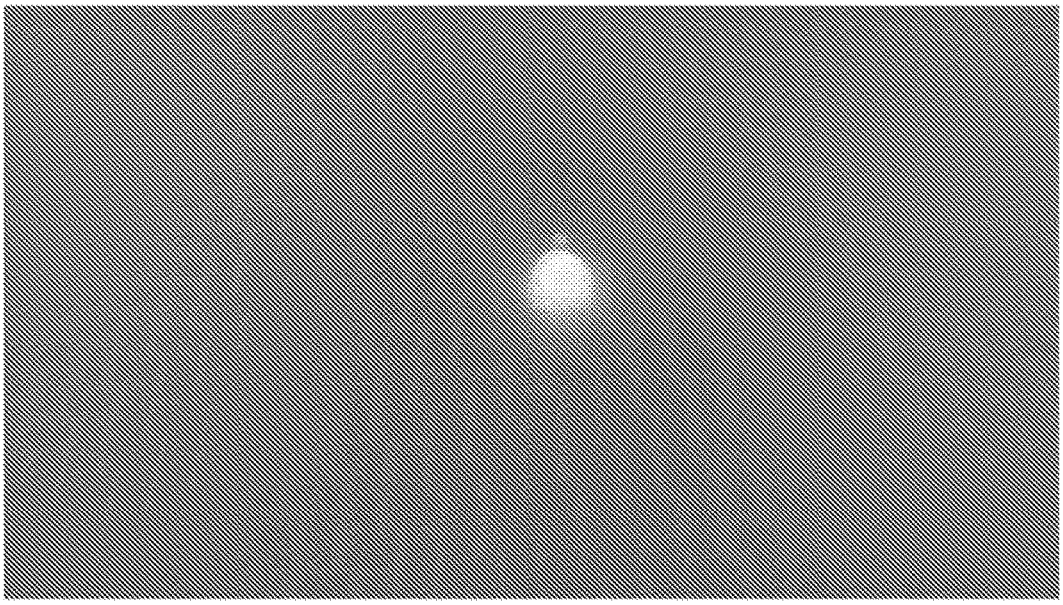
FIGS. 13A and 13B are photographs of a drop of water, containing a fluorescent salt, applied to the working surface of a polishing layer, before and after plasma treatment of the polishing layer, respectively.
Figure 13B:
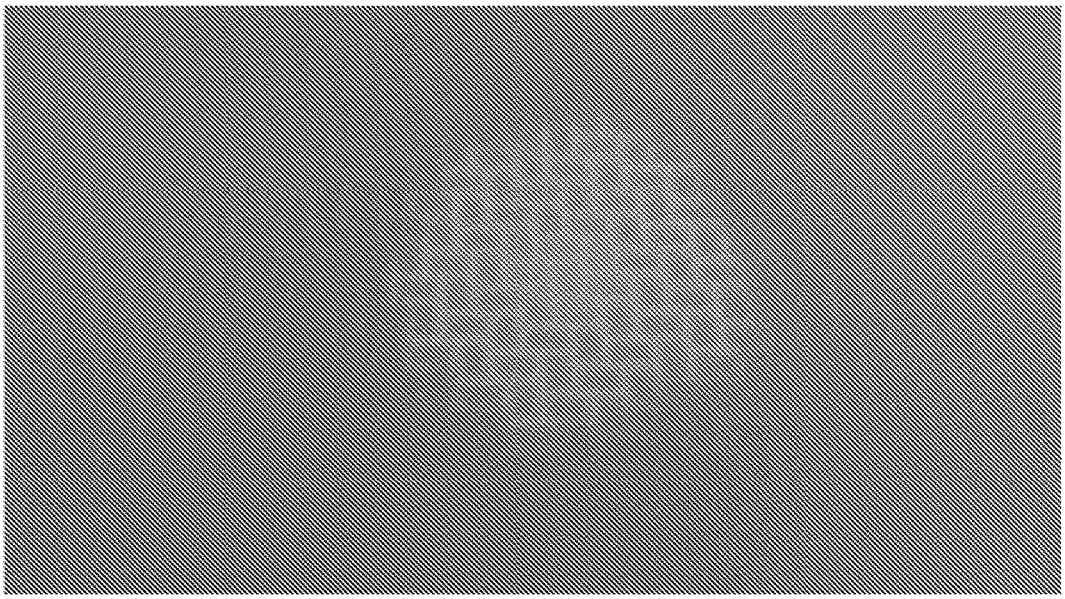

The plasma treatment resulted in the formation of a nanometer-size topographical structure on the surface of the polishing layer. FIGS. 12A and 12B show a small area of the polishing layer surface before and after plasma treatment, respectively. Before plasma treatment, the surface was very smooth, FIG. 12A. After plasma treatment, a nanometer-size texture was observed in the polishing layer surface, FIG. 12B. Note that the scale (white bar) shown in both FIGS. 12A and 12B represents 1 micron. FIGS. 12C and 12D show images of FIGS. 12A and 12B, respectively, at higher magnification. The scale (white bar) shown in these two figures represents 100 nm. FIGS. 12B and 12D show that the plasma treatment formed a random array of irregularly shaped domains on the surface, the domain size being less than about 500 nm, even less than about 250 nm. Irregular grooves separate the domains and the width of these grooves is less than about 100 nm, even less than about 50 nm. The depth of the grooves is about on the same size order as their width. The surface treatment caused a dramatic increase in the hydrophilic nature of the pad surface as illustrated in FIGS. 13A and 13B. FIG. 13A shows a photograph taken under black light of a drop of water (containing less than about 0.1% by weight Fluorescein Sodium salt, $C_{20}H_{10}Na_2O_5$, available from Sigma-Aldrich Company, LLC, St. Louis, Mo.) on the surface of the polishing layer of Example 1, prior to the formation of the nanometer-size topographical features. The drop of water readily beaded on the polishing layer and maintained its, generally, spherical shape, indicating that the surface of polishing layer was hydrophobic. FIG. 13B shows a drop of water, with salt, on the surface of the polishing layer after plasma treatment and the formation of the nanometer-sized topographical features. The drop of water readily wetted the surface of polishing layer, indicating that the surface of polishing layer had become significantly more hydrophilic.

A polishing pad was formed by laminating three, approximately 36 inch long×14 inch wide, pieces of the surface modified, polishing layer film to a polymeric foam; a 10 mil (0.254 mm) thick white foam, Volara Grade 130HPX0025WY Item number VF130900900 with a density of 12 pounds per cubic foot, available from Voltek a Division of Sekisui America Corporation, Coldwater, Mo. using 3M DOUBLE COATED TAPE 442DL, available from the 3M Company, St. Paul, Minn. The second surface, i.e. the non-working surface, of the polishing layer was laminated to the foam. The foam sheet was about 36 inch (91 cm)×36 inch (91 cm) and the polishing layer films were laminate adjacent to one another, minimizing the seam between them. Prior to laminating the polishing layer film to the foam, a 20 mil (0.508 mm) thick polycarbonate sheet, i.e. a subpad, was first laminated to one surface of the foam via a layer of 442DL tape. A final layer of 442DL tape was laminated to the exposed surface of the polycarbonate sheet. This last adhesive layer was used to laminate the polishing pad to the platen of a polishing tool. A 30.5 inch diameter pad was die cut using convention techniques forming the polishing pad of Example 1. Several pads were made in this manner and will all be considered as Example 1.

An endpoint window was formed in the polishing pad by cutting and removing an appropriate size strip of the polycarbonate layer and foam layer, leaving the polyurethane polishing layer intact. When the polishing pad of Example 1 was placed on a polishing tool, an Applied Materials REFLEXION tool, an endpoint signal suitable for endpoint detection on a wafer surface was obtained.

Wafer polishing was subsequently conducted using the polishing pads of Example 1 and various wafer substrates, corresponding slurries and the wafer polishing methods described above. As shown in Tables 1-5, the polishing pad of Example 1 provides very good CMP performance for Cu, tungsten, thermal oxide and Cu barrier applications. Better wafer removal rates and wafer non-uniformities were obtained in most cases, as compared to benchmarked consumable sets.

TABLE 1

200 mm Cu Wafer Polishing Results for Example 1

| Polishing Time (min) | Removal Rate (Å/min) | Non-Uniformity (%) |
|---|---|---|
| 5 | 7029 | 3.0 |
| 10 | 7473 | 3.5 |
| 20 | 7465 | 4.3 |
| 30 | 7393 | 4.3 |
| 35 | 6791 | 4.9 |
| 45 | 6848 | 3.6 |
| 55 | 6702 | 3.2 |
| 80 | 7130 | 3.2 |
| 105 | 7816 | 4.4 |
| 130 | 6945 | 3.7 |
| 155 | 6734 | 5.3 |
| 180 | 6974 | 5.7 |
| 205 | 6997 | 3.8 |

TABLE 2

300 mm Cu Wafer Polishing Results for Example 1

| Polishing Time (min) | Removal Rate (Å/min) | Non-Uniformity (%) |
|---|---|---|
| 30 | 5840 | 5.8 |
| 35 | 6320 | 4.8 |

TABLE 2-continued 300 mm Cu Wafer Polishing Results for Example 1

| Polishing Time (min) | Removal Rate (Å/min) | Non-Uniformity (%) |
|---|---|---|
| 40 | 6489 | 6.4 |
| 45 | 6503 | 5.2 |
| 50 | 6578 | 6.2 |

TABLE 3

200 mm Tungsten Wafer Polishing Results for Example 1

| Polishing Time (min) | Removal Rate (Å/min) | Non-Uniformity (%) |
|---|---|---|
| 100 | 1816 | 2.6 |
| 110 | 1842 | 2.8 |
| 130 | 1806 | 2.6 |
| 140 | 1805 | 2.4 |
| 150 | 1818 | 2.2 |
| 160 | 1771 | 2.2 |
| 170 | 1787 | 1.7 |
| 180 | 1760 | 2.5 |
| 190 | 1781 | 2.5 |
| 200 | 1775 | 2.1 |
| 210 | 1764 | 2.3 |
| 220 | 1747 | 1.7 |
| 230 | 1439 | 2.3 |
| 240 | 1420 | 1.9 |
| 245 | 1760 | 3.1 |
| 250 | 1489 | 1.8 |
| 260 | 1898 | 2.4 |
| 270 | 1880 | 3.2 |
| 280 | 1927 | 2.9 |
| 290 | 1894 | 2.4 |
| 300 | 1809 | 2.3 |
| 310 | 1904 | 3.1 |
| 320 | 1826 | 3.5 |
| 330 | 1832 | 3.2 |
| 340 | 1803 | 3.9 |
| 350 | 1806 | 2.8 |
| 360 | 1810 | 2.8 |
| 370 | 1743 | 3.6 |
| 410 | 1742 | 3.6 |
| 420 | 1852 | 3.8 |
| 430 | 1986 | 4.1 |

TABLE 4

200 mm Thermal Oxide Wafer Polishing Results for Example 1 (CES-333 slurry)

| Polishing Time (min) | Removal Rate (Å/min) | Non-Uniformity (%) |
|---|---|---|
| 175 | 1836 | 14.2 |
| 200 | 2048 | 12.7 |
| 225 | 1981 | 7.6 |
| 250 | 1998 | 9.3 |
| 275 | 2029 | 8.0 |
| 300 | 2103 | 6.9 |
| 325 | 2055 | 6.1 |
| 350 | 2145 | 5.4 |
| 375 | 2295 | 5.9 |
| 400 | 2374 | 6.1 |
| 425 | 2373 | 4.4 |
| 450 | 2446 | 5.0 |
| 475 | 2251 | 5.8 |
| 500 | 2245 | 4.9 |
| 525 | 2314 | 4.6 |
| 550 | 2118 | 7.6 |
| 575 | 2187 | 3.7 |
| 600 | 2310 | 5.6 |
| 625 | 2302 | 4.9 |

TABLE 4-continued

| 200 mm Thermal Oxide Wafer Polishing Results for Example 1 (CES-333 slurry) | | |
|---|---|---|
| Polishing Time (min) | Removal Rate (Å/min) | Non-Uniformity (%) |
| 650 | 2162 | 4.6 |
| 675 | 1254 | 5.7 |
| 700 | 1220 | 5.3 |
| 725 | 1338 | 5.2 |
| 750 | 2320 | 3.4 |
| 775 | 2114 | 5.5 |
| 792 | 2084 | 4.0 |

TABLE 5

| 200 mm Thermal Oxide Wafer Polishing Results for Example 1 (I-CUE-7002 slurry) | | | |
|---|---|---|---|
| Polishing Time (min) | Slurry Flow Rate (ml/min) | Removal Rate (Å/min) | Non-Uniformity (%) |
| 5 | 150 | 878 | 2.0 |
| 10 | 150 | 884 | 1.5 |
| 15 | 300 | 949 | 1.7 |
| 20 | 300 | 950 | 1.7 |
| 25 | 300 | 941 | 2.1 |

Figure 14A:
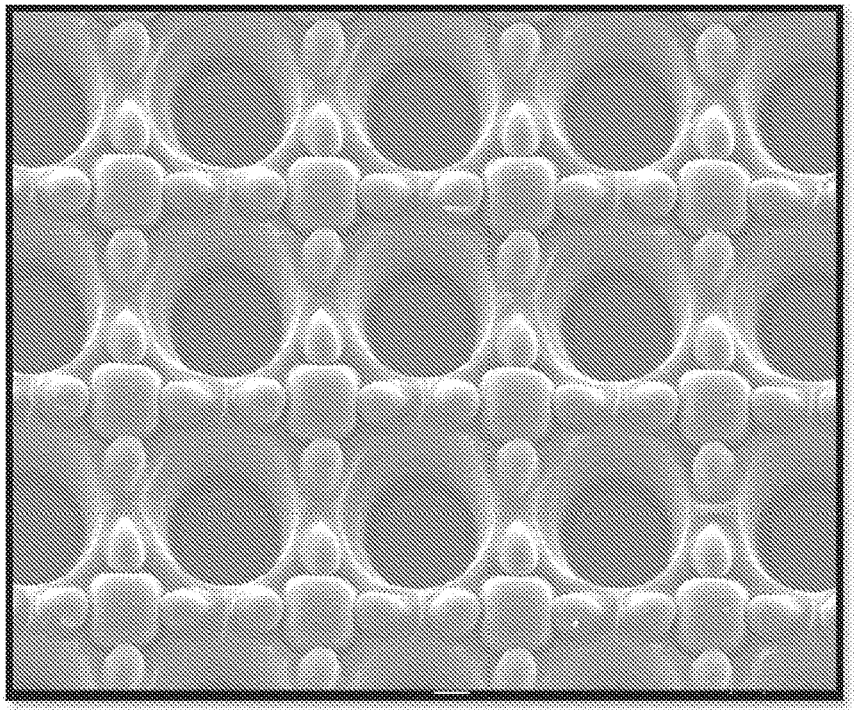
FIGS. 14A and 14B are SEM images of a portion of a polishing layer of Example 1 before and after conducting tungsten CMP, respectively.
Figure 14B:
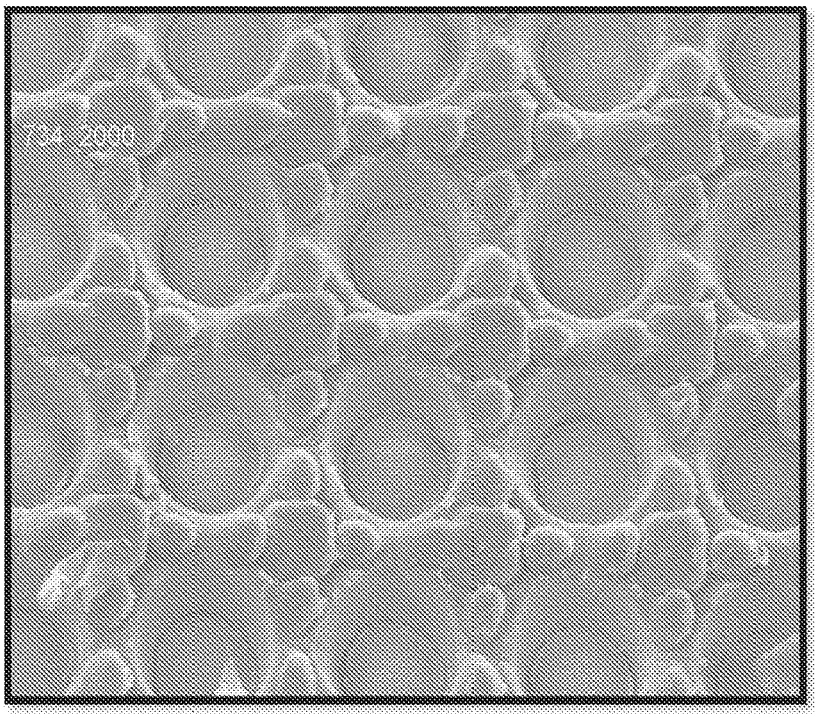

FIGS. 14A and 14B show SEM images of a portion of a polishing layer of Example 1, before and after the tungsten CMP was conducted, respectively. Tungsten slurries are known to lead to aggressive pad wear. However, the working surface of the polishing layer showed little wear after 430 minutes of polishing with the tungsten slurry, Table 3. Similar results, i.e. little to no wear of the working surface of the polishing layer, were also observed for Example 1 after both Cu and thermal oxide CMP.

Example 2

Example 2 was prepared identically to Example 1 above, except the plasma treatment was not used. Subsequently, the nanometer-size topographical structure was not present on the surface of the polishing layer, FIGS. 12A and 12C. An endpoint window was formed in the polishing pad by cutting and removing an appropriate size strip of the polycarbonate layer and foam layer, leaving the polyurethane polishing layer intact.

Wafer polishing was subsequently conducted using the polishing pad of Example 2 using the "200 mm Thermal Oxide Wafer Polishing Method 1", described above. Thermal oxide removal rate and wafer non-uniformity as a function of polishing time was determined, Table 6.

TABLE 6

| 200 mm Thermal Oxide Wafer Polishing Results for Example 2 (CES-333 slurry) | | |
|---|---|---|
| Polishing Time (min) | Removal Rate (Å/min) | Non-Uniformity (%) |
| 60 | 123 | 53.7 |
| 120 | 721 | 25.2 |
| 180 | 1005 | 16.9 |
| 240 | 1171 | 16.4 |

TABLE 6-continued

| 200 mm Thermal Oxide Wafer Polishing Results for Example 2 (CES-333 slurry) | | |
|---|---|---|
| Polishing Time (min) | Removal Rate (Å/min) | Non-Uniformity (%) |
| 300 | 1329 | 17.5 |
| 360 | 1423 | 17.2 |
| 420 | 1503 | 22.7 |
| 480 | 1627 | 19.0 |
| 540 | 1566 | 18.2 |
| 600 | 816 | 45.4 |
| 660 | 1512 | 23.3 |
| 720 | 1684 | 18.1 |
| 780 | 1799 | 22.4 |
| 840 | 1744 | 17.7 |
| 900 | 1731 | 18.5 |
| 960 | 1860 | 21.5 |
| 1020 | 1783 | 17.1 |
| 1080 | 1648 | 16.8 |
| 1140 | 1718 | 20.5 |
| 1200 | 1713 | 15.4 |
| 1320 | 1703 | 15.5 |
| 1380 | 1704 | 15.6 |
| 1440 | 1595 | 16.8 |
| 1500 | 1699 | 20.0 |

As shown in Table 6, the polishing pad of Example 2 provides good CMP performance in a thermal oxide CMP application. Comparing the data of Table 4 and Table 6, the thermal oxide removal rates were significantly higher for Example 1 (with nanometer-size topographical features present on the surface of the polishing layer) compared to Example 2 (without the nanometer-size topographical features on the surface of the polishing layer). The wafer non-uniformities were also lower for wafers polished with Example 1 compared to wafers polished with Example 2.

Example 3 Through Example 5

Figure 15A:
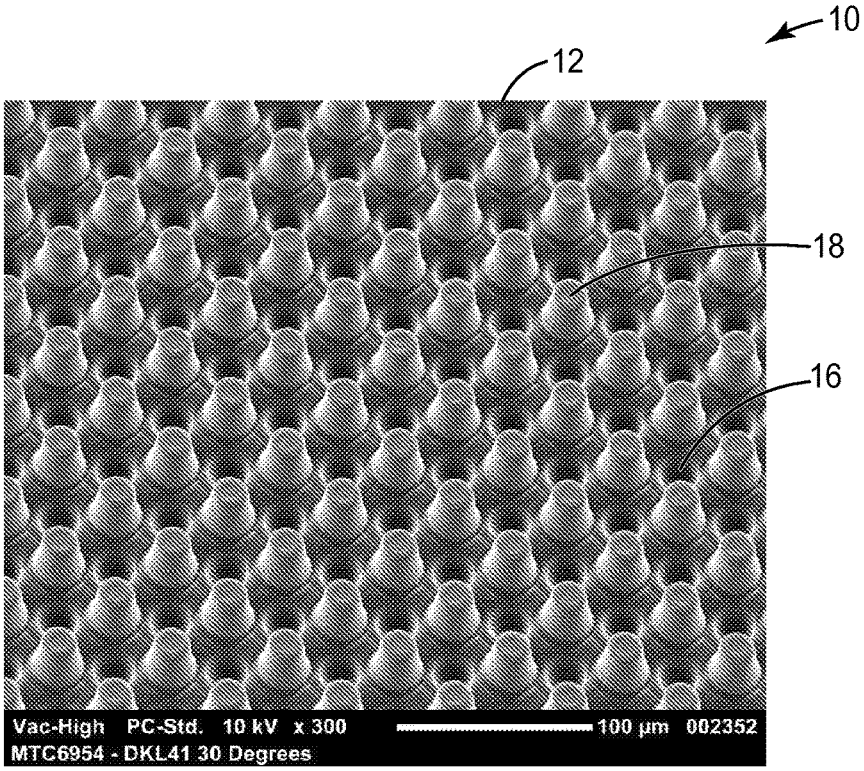
FIG. 15A is an SEM image of a portion of a polishing layer of the polishing pad of Example 3.
Figure 15B:
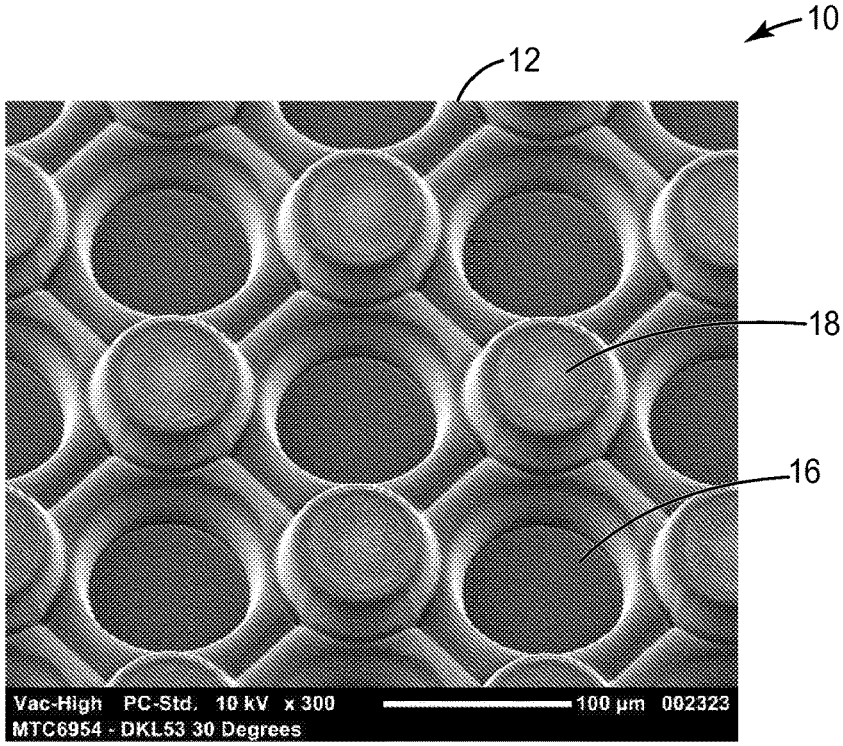
FIG. 15B is an SEM image of a portion of a polishing layer of the polishing pad of Example 5.

Three polishing pads were fabricated each including only a polishing layer. The polishing layer included a plurality of precisely shaped asperities and a plurality of precisely shaped pores, the asperities being tapered cylinders and the pores being generally hemispherical shaped having the dimension indicated in Tables 7A, 7B and 7C. Both the plurality of precisely shaped asperities and the plurality of precisely shaped pores were configured in a square array pattern with a pitch (center to center distance between adjacent, similar features) as indicated in Tables 7A, 7B and 7C. Formation of the corresponding master tools, negative master tools and the larger negative master tools, as well as, the embossing process used to fabricate each polishing layer was as described in Example 1. FIG. 15A and FIG. 15B show SEM images of Example 3 and Example 5, respectively.

TABLE 7A

Feature Dimension of Example 3

| | Asperity | | | Pore | | | |
|---|---|---|---|---|---|---|---|
| | Height (microns) | Distal End Diameter (microns) | Pitch (microns) | Depth (microns) | Diameter @ Pore Opening (microns) | Pitch (microns) | Bearing Area[c] (%) |
| Average | 26.0 | 17.8 | 41.6 | 21.3 | 24.0 | 41.5 | 17.8 |
| Std. Dev. | 0.7 | 0.6 | 0.9 | 0.3 | 0.7 | 0.9 | 0.5 |
| % NU[a] | 2.8 | 3.4 | 2.2 | 1.5 | 3.1 | 2.2 | 3.0 |
| N[b] | 20 | 20 | 20 | 20 | 20 | 20 | 4[d] |

[a]% NU is the Standard Deviation (Std. Dev.) divided by the Average mulitplied by 100.

[b]N is the sample size.

[c]Bearing area is the area of the distal ends of a sample area divided by the projected pad area of that sample area multiplied by 100 to obtain a percentage.

[d]Four regions of the pad were measured with 12 asperities, 12 asperities, 13 apserities and 13 asperities measured per region, respectivley.

TABLE 7B

Feature Dimension of Example 4

| | Asperity | | | Pore | | | |
|---|---|---|---|---|---|---|---|
| | Height (microns) | Distal End Diameter (microns) | Pitch (microns) | Depth (microns) | Diameter @ Pore Opening (microns) | Pitch (microns) | Bearing Area[c] (%) |
| Average | 29.3 | 48.0 | 102.9 | 27.3 | 79.5 | 103.3 | 18.8 |
| Std. Dev. | 1.6 | 1.1 | 0.9 | 0.3 | 1.2 | 1.4 | 0.2 |
| % NU[a] | 5.4 | 2.2 | 0.8 | 1.1 | 1.6 | 1.4 | 1.0 |
| N[b] | 20 | 20 | 20 | 20 | 20 | 20 | 8[d] |

[a]% NU is the Standard Deviation (Std. Dev.) divided by the Average mulitplied by 100.

[b]N is the sample size.

[c]Bearing area is the area of the distal ends of a sample area divided by the projected pad area of that sample area multiplied by 100 to obtain a percentage.

(d) Eight regions of the pad were measured with 2 asperities measured per region.

TABLE 7C

Feature Dimension of Example 5

| | Asperity | | | Pore | | | |
|---|---|---|---|---|---|---|---|
| | Height (microns) | Distal End Diameter (microns) | Pitch (microns) | Depth (microns) | Diameter @ Pore Opening (microns) | Pitch (microns) | Bearing Area[c] (%) |
| Average | 27.5 | 77.2 | 143.7 | 29.8 | 103.9 | 144.1 | 24 |
| Std. Dev. | 1.9 | 1.3 | 1.4 | 0.3 | 1.8 | 1.7 | 0.2 |
| % NU[a] | 6.9 | 1.7 | 1.0 | 1.0 | 1.7 | 1.2 | 0.9 |
| N[b] | 20 | 20 | 20 | 20 | 20 | 20 | 16[d] |

[a]% NU is the Standard Deviation (Std. Dev.) divided by the Average mulitplied by 100.

[b]N is the sample size.

[c]Bearing area is the area of the distal ends of a sample area divided by the projected pad area of that sample area multiplied by 100 to obtain a percentage.

[d]Sixteen regions of the pad were measured with 1 asperities measured per region.

What is claimed is:

1. A polishing pad comprising a polishing layer having a working surface and a second surface opposite the working surface;

wherein the working surface includes a plurality of precisely shaped pores, a plurality of precisely shaped asperities and a land region;

wherein each pore has a pore opening, each asperity has an asperity base, and a plurality of the asperity bases are substantially coplanar relative to at least one adjacent pore opening;

wherein the depth of the plurality of precisely shaped pores is less than the thickness of the land region adjacent to each precisely shaped pore and the thickness of the land region is less than about 5 mm; and wherein the polishing layer comprises a polymer.

2. The polishing pad of claim 1, wherein the height of at least about 10% of the plurality of precisely shaped asperities is between about 1 micron and about 200 microns.

3. The polishing pad of claim 1, wherein the depth of at least about 10% of the plurality of precisely shaped pores is between about 1 micron and about 200 microns.

4. The polishing pad of claim 1, wherein the areal density of the plurality of precisely shaped asperities is independent of the areal density of the plurality precisely shaped pores.

5. The polishing pad of claim 1, wherein the polishing layer further comprises a polymer, wherein the polymer includes including thermoplastics, thermoplastic elastomers (TPEs), thermosets and combinations thereof.

6. The polishing pad of claim 5, wherein the polymer includes a thermoplastic or thermoplastic elastomer.

7. The polishing pad of claim 6, wherein the thermoplastic and thermoplastic elastomer include polyurethanes, polyalkylenes, polybutadiene, polyisoprene, polyalkylene oxides, polyesters, polyamides, polycarbonates, polystyrenes, block copolymers of any of the proceeding polymers, and combinations thereof.

8. The polishing pad of claim 1, wherein the polishing layer is free of through-holes.

9. The polishing pad of claim 1, wherein the polishing layer is a unitary sheet.

10. The polishing pad of claim 1, wherein the polishing layer contains less than 1% by volume inorganic abrasive particles.

11. The polishing pad of claim 1, wherein the precisely shaped asperities are solid structures.

12. The polishing pad of claim 1, wherein the precisely shaped asperities are free of machined holes.

13. The polishing pad of claim 1, wherein, the polishing layer is flexible and capable of being bent back upon itself producing a radius of curvature in the bend region of between about 10 cm and about 0.1 mm.

14. The polishing pad of claim 1, wherein the ratio of the surface area of the distal ends of the precisely shaped asperities to the projected polishing pad surface area is between about 0.0001 and about 4.

15. The polishing pad of claim 1, wherein the ratio of the surface area of the distal ends of the precisely shaped asperities to the surface area of the precisely shaped pore openings is between about 0.0001 and about 4.

16. The polishing pad of claim 1, further comprising at least one macro-channel.

17. The polishing pad of claim 16, wherein the depth of at least a portion of the plurality of precisely shaped pores is less than the depth of at least a portion of the at least one macro-channel.

18. The polishing pad of claim 16, wherein the width of at least a portion of the plurality of precisely shaped pores is less than the width of at least a portion of the at least one macro-channel.

19. The polishing pad of claim 16, wherein the ratio of the depth of at least a portion of the at least one macro-channel to the depth of a portion of the precisely shaped pores is between about 1.5 and about 1000.

20. The polishing pad of claim 16, wherein the ratio of the width of at least a portion of the at least one macro-channel to the width of a portion of the precisely shaped pores is between about 1.5 and about 1000.

21. The polishing pad of claim 1, wherein at least a portion of the precisely shaped asperities include a flange.

22. The polishing pad of claim 1, wherein the polishing layer includes a plurality of nanometer-size topographical features on at least one of the surface of the precisely shaped asperities, the surface of the precisely shaped pores and the surface of the land region.

23. The polishing pad of claim 22, wherein the plurality of nanometer sized features include regular or irregularly shaped grooves, wherein the width of the grooves is less than about 250 nm.

24. The polishing pad of claim 1, wherein the working surface comprises a secondary surface layer and a bulk layer and wherein the chemical composition in at least a portion of the secondary surface layer differs from the chemical composition within the bulk layer.

25. The polishing pad of claim 24, wherein the chemical composition in at least a portion of the secondary surface layer, which differs from the chemical composition within the bulk layer, includes silicon.

26. The polishing pad of claim 1, wherein at least one of the receding contact angle and advancing contact angle of the secondary surface layer is less than the corresponding receding contact angle and advancing contact angle of the bulk layer.

27. The polishing pad of claim 26, wherein at least one of the receding contact angle and advancing contact angle of the secondary surface layer is at least about 20° less than the corresponding receding contact angle or advancing contact angle of the bulk layer.

28. The polishing pad of claim 1, wherein the receding contact angle of the working surface is less than about 50°.

29. The polishing pad of claim 1, wherein the receding contact angle of the working surface is less than about 30°.

30. The polishing pad of claim 1, wherein the polishing layer is substantially free of inorganic abrasive particles.

31. The polishing pad of claim 1, wherein the polishing layer further comprises a plurality of independent or interconnected macro-channels.

32. The polishing pad of claim 1, further comprising a subpad, wherein the subpad is adjacent to the second surface of the polishing layer.

33. The polishing pad of claim 32, further comprising a foam layer, wherein the foam layer is interposed between the second surface of the polishing layer and the subpad.

34. A polishing system comprising the polishing pad of claim 1 and a polishing solution.

35. The polishing system of claim 34, wherein the polishing solution is a slurry.

36. The polishing system of claim 35, wherein the polishing layer contains less than 1% by volume inorganic abrasive particles.

37. The polishing pad of claim 1, further comprising at least one second polishing layer having a working surface and a second surface opposite the working surface; wherein the working surface includes a plurality of precisely shaped pores, a plurality of precisely shaped asperities and a land region;

wherein each pore has a pore opening, each asperity has an asperity base, and a plurality of the asperity bases are substantially coplanar relative to at least one adjacent pore opening;

wherein the depth of the plurality of precisely shaped pores is less than the thickness of the land region adjacent to each precisely shaped pore and the thickness of the land region is less than about 5 mm;

wherein the at least one second polishing layer comprises a polymer; and wherein the second surface of the polishing layer is adjacent to the working surface of the at least one second polishing layer.

38. The polishing pad of claim 37, further comprising an adhesive layer disposed between the second surface of the polishing layer and the working surface of the at least one second polishing layer.

39. The polishing pad of claim 38, wherein the adhesive layer is a pressure sensitive adhesive layer.

40. The polishing pad of claim 37, further comprising a foam layer disposed between the second surface of the polishing layer and the working surface of the at least one second polishing layer and a second foam layer adjacent the second surface of the at least one second polishing layer.

41. A method of polishing a substrate, the method comprising:

providing a polishing pad according to claim 1;

providing a substrate;

contacting the working surface of the polishing pad with the substrate surface;

moving the polishing pad and the substrate relative to one another while maintaining contact between the working surface of the polishing pad and the substrate surface;

and wherein polishing is conducted in the presence of a polishing solution.

42. The method of polishing a substrate of claim 41, wherein the substrate is a semiconductor wafer.

43. The method of polishing a substrate of claim 41, wherein the semiconductor wafer surface in contact with the working surface of the polishing pad includes at least one of a dielectric material and an electrically conductive material.

* * * * *